US011412908B2

(12) United States Patent
Ko et al.

(10) Patent No.: US 11,412,908 B2
(45) Date of Patent: Aug. 16, 2022

(54) ROBOT CLEANER

(71) Applicant: LG ELECTRONICS INC., Seoul (KR)

(72) Inventors: Moohyun Ko, Seoul (KR); Donggeun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/944,375

(22) Filed: Jul. 31, 2020

(65) Prior Publication Data

US 2021/0186294 A1 Jun. 24, 2021

(30) Foreign Application Priority Data

Jul. 31, 2019 (KR) ..... 10-2019-0093494

(51) Int. Cl.
*A47L 11/40* (2006.01)

(52) U.S. Cl.
CPC ..... *A47L 11/4083* (2013.01)

(58) Field of Classification Search
CPC ..... A47L 11/408; A47L 11/4083; A47L 11/4013; A47L 11/4016; A47L 2201/00; A47L 9/2873; A47L 2201/02; A47L 7/0004; A47L 5/365; A47L 7/0038
See application file for complete search history.

(56) References Cited

U.S. PATENT DOCUMENTS

| | | | | |
|---|---|---|---|---|
| 2019/0038101 | A1 | 2/2019 | Jang et al. | |
| 2019/0191952 | A1 | 6/2019 | Johnson et al. | |
| 2019/0290089 | A1* | 9/2019 | Johnson | A47L 11/305 |
| 2020/0323413 | A1* | 10/2020 | Li | A47L 11/4005 |

FOREIGN PATENT DOCUMENTS

| | | |
|---|---|---|
| CN | 106901665 | 6/2017 |
| KR | 10-2006-0115220 | 11/2006 |
| KR | 10-2007-0018641 | 2/2007 |

(Continued)

OTHER PUBLICATIONS

Irobot, Owner's Guide, https://prod-help-content.care.irobotapi.com/files/i_series/i7/ownersGuide/og-i7-en-GB.pdf, 2018 (Year: 2018).*

(Continued)

*Primary Examiner* — Joseph J Hail
*Assistant Examiner* — Timothy Brady
(74) *Attorney, Agent, or Firm* — KED & Associates, LLP

(57) ABSTRACT

A robot cleaner may have a body, a mop, and a tank to supply water to the mop. The tank may be magnetically coupled to the body via at least one magnet and be physically coupled to the body via a groove and a protrusion The protrusion may be a bent rib extending from the tank to couple to a groove in the body, or the protrusion may be a stopper attached to a spring attached to the body and coupling with a groove in the tank. The at least one magnet may be provided at a first side with respect to a left-right center, and the protrusion and groove may be provided at a second side opposite the first side. To remove the tank from the body, the tank may be pulled near the magnet to detach the tank at the magnet, and the tank may be rotated at a point on the second side.

20 Claims, 13 Drawing Sheets

(56) References Cited

FOREIGN PATENT DOCUMENTS

| | | |
|---|---|---|
| KR | 10-0704484 | 4/2007 |
| KR | 10-0836680 | 6/2008 |
| KR | 10-2008-0100981 | 11/2008 |
| KR | 10-2009-0102296 | 9/2009 |
| KR | 10-2010-0076134 | 7/2010 |
| KR | 10-2013-0058495 | 6/2013 |
| KR | 10-1329605 | 11/2013 |
| KR | 10-2016-0121844 | 10/2016 |
| KR | 10-2017-0034362 | 3/2017 |
| KR | 10-2018-0008251 | 1/2018 |
| KR | 10-2018-0042923 | 4/2018 |
| KR | 10-2019-00159460 | 2/2019 |

OTHER PUBLICATIONS

Youtube Video—https://www.youtube.com/watch ?v=W9_Mur3kdrY—iRobot (Year: 2020).*

Korean Office Action dated Sep. 22, 2020 issued in Application No. 10-2019-0093491.

Korean Office Action dated Sep. 23, 2020 issued in Application No. 10-2019-0093492.

U.S. Appl. No. 16/944,355, filed Jul. 31, 2020.

U.S. Appl. No. 16/944,375, filed Jul. 31, 2020.

U.S. Appl. No. 16/943,288, filed Jul. 30, 2020.

International Search Report dated Nov. 13, 2020 issued in Application No. PCT/KR2020/010122.

Korean Office Action dated Sep. 28, 2020 issued in Application No. 10-2019-0093494.

Korean Notice of Allowance dated Sep. 28, 2021 issued in KR Application No. 10-2021-0079321.

United States Office Action dated Apr. 27, 2022 issued in co-pending related U.S. Appl. No. 16/943,288.

University of Virginia, Lecture 8 Magnetic Fields Chp. 29, Jul. 14, 2006, Slide 5, http://galileo.phys.virginia.edu/classes/632.ral5q.summer06/Lecture1-16_Powerpoints/lecture_8_mat/PHYS632_C8_28_Mag_Field.pdf (Year: 2006).

* cited by examiner

ROBOT CLEANER

CROSS-REFERENCE TO RELATED APPLICATION(S)

This application claims priority under 35 U.S.C. § 119 to Korean Application No. 10-2019-0093494, filed in Korea on Jul. 31, 2019, whose entire disclosure(s) is/are hereby incorporated by reference.

BACKGROUND

1. Field

The present disclosure relates to a robot cleaner.

2. Background

Robot cleaners for cleaning the floor or other surfaces to be cleaned (hereinafter, "floors") have recently been developed. Robot cleaners travel across floors to remove foreign materials by suctioning or wiping the foreign materials from the floor surface.

A robot cleaner capable of mopping the floor may move on the surface by rotational friction while rotating about a rotary shaft, which is approximately perpendicular to the floor surface, and by mopping the surface with the rotational friction. A robot cleaner may mop the floor surface with a wet mop. Such a robot cleaner may have a water tank to supply water to spin mops rotating and mopping the floor.

While such a wet mopping robot cleaner may have a stable structure, robot cleaners having a detachable water tank may experience leaking from a connection portion.

Korean Laid-open Patent Publication No. KR10-2019-0015940 discloses a robot cleaner having a detachable water tank without a fixing and a pressing means provided separately for a connection portion, causing Furthermore, if a strong fixing and pressing means are provided to securely mount the water tank, it may be difficult to separate the water tank from the mounting structure, and when a user attempts to separate the water tank, the water tank may be damaged or water in the water tank may leak.

BRIEF DESCRIPTION OF THE DRAWINGS

Embodiments will be described in detail with reference to the following drawings in which like reference numerals refer to like elements, and wherein.

DETAILED DESCRIPTION

In the description of a robot cleaner and a water tank, a direction in which the water tank is withdrawn may be defined as a rear direction, a direction opposite to the rear direction may be defined as a front direction, a direction in which a spin mop is provided may be defined as a lower direction, and a direction opposite to the lower direction may be defined as an upper direction. Further, a direction of both sides which is perpendicular to the front direction, the rear direction, the upper direction and the lower direction may be defined as a left-right direction. A configuration of the water tank will be described based on the above directions when the water tank is mounted in a water tank housing.

A direction parallel to a virtual line, formed by connecting a central axis Osa of a left spin mop 41*a* and a central axis Osb of a right spin mop 41*b* (FIG. 12) may be defined as a left-right direction and a direction which vertically intersects the left-right direction and in which the water tank is positioned may be defined as a rear direction.

Hereinafter, embodiments of the present disclosure will be described in detail with reference to the accompanying drawings provided for explaining a robot cleaner.

<Overall Configuration>

Figure 1A:
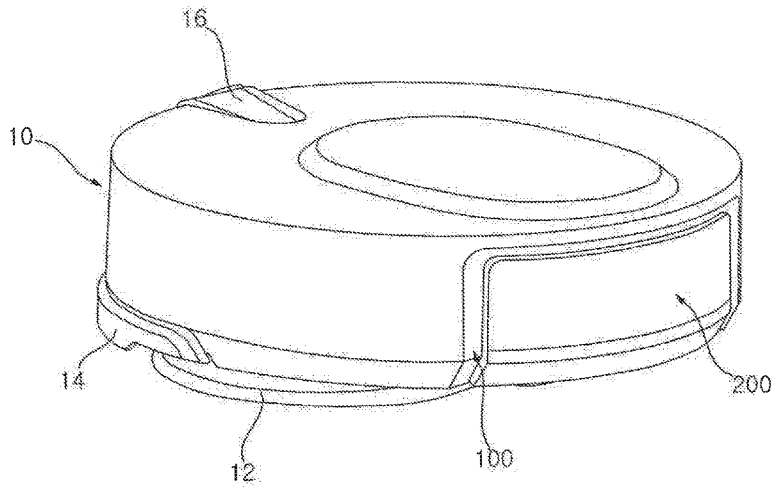
FIG. 1A is a rear perspective view of a robot cleaner according to an embodiment of the present disclosure.

Referring to FIG. 1, an overall configuration of a robot cleaner 1 according to an embodiment of the present disclosure will be described below.

The robot cleaner 1 may include a body or a main body 10 forming an exterior of the robot cleaner 1 and having an internal space, at least one (e.g., two) spin mops 12 provided at a lower side of the body 10, a water tank 200 mounted at the body 10 to store water or liquid to be supplied to the pair of spin mops 12, and a water supply module or assembly provided inside of the body 10 to supply the water stored in the water tank 200 to each of the pair of spin mops 12. The spin mops 12 may not only mop a surface to be cleaned (e.g., a floor surface), but also move the body 10 while rotating. Although the drawings show a pair of spin mops 12, embodiments disclosed herein are not limited.

The robot cleaner 1 may further include a bumper 14 mounted at the front of the body 10 to absorb any shock caused by coming in contact with obstacles on the floor surface. A sensor 16 may sense a position of the body 10 and detect obstacles.

The body 10 may have a flat disc shape. In the internal space of the body 10, a printed circuit board (PBC) may be provided, which includes a controller to adjust a rotation speed of the pair of spin mops 12 or to adjust an amount of water to be supplied from the water tank 200 to the pair of spin mops 12 by controlling the water supply module. In the internal space of the body 10, external power may be supplied to charge a battery, and charged power from the battery (or alternatively, directly from a commercial external power supply via a cable) may be provided to the printed circuit board or to a motor that rotates the pair of spin mops 12.

The water supply module may include a supply nozzle 110 connected to the water tank 200 mounted at the body 10, a supply hose or channel to connect the supply nozzle 110 and each of the spin mops 12, and a pump provided at the supply hose to suction water stored in the water tank 200 to deliver the water to the spin mops 12.

Figure 12:
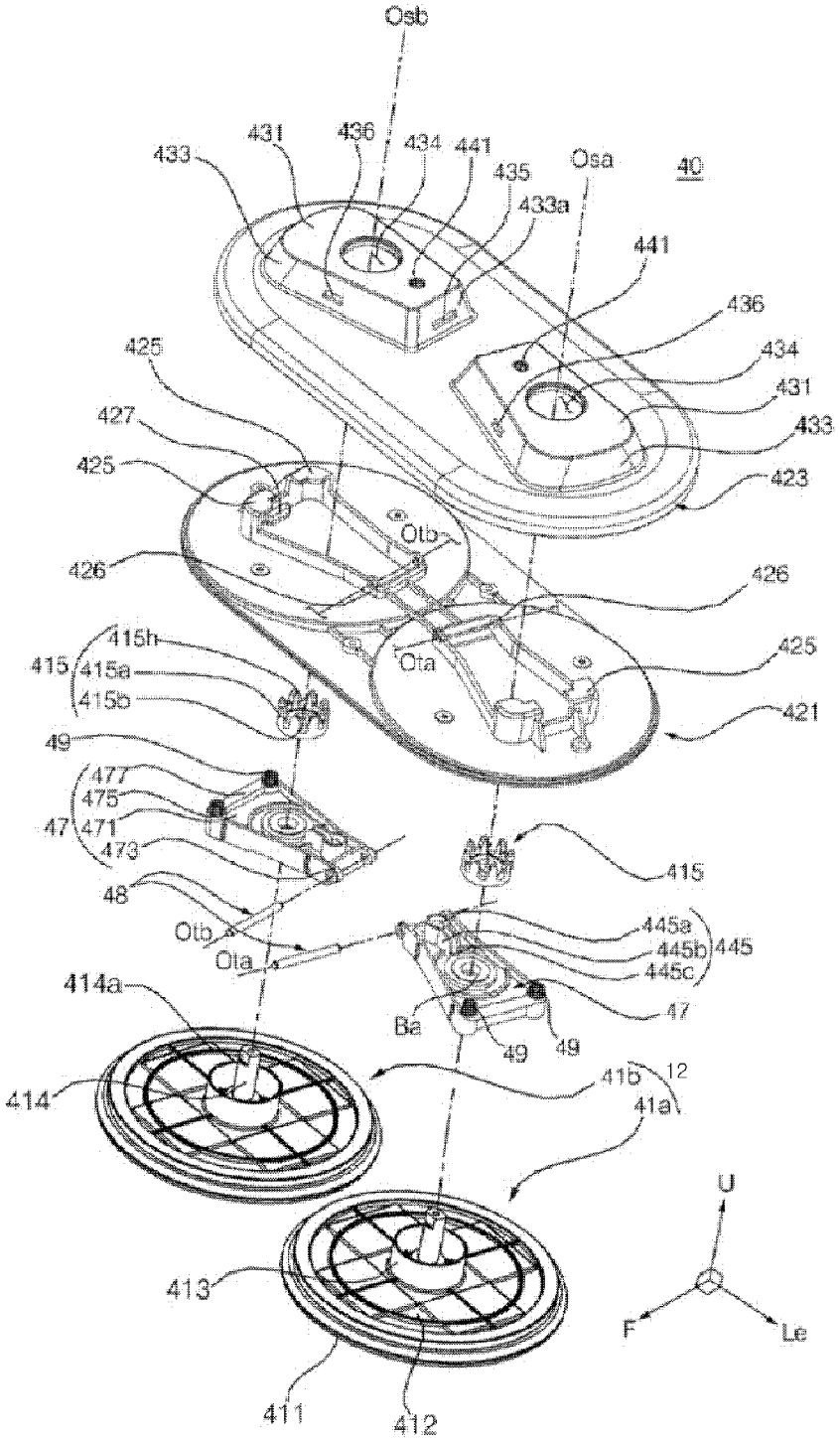
FIG. 12 is an exploded perspective view of the mop module of FIG. 11.

The pair of spin mops 12 may mop the floor by rotating clockwise or counterclockwise when viewed from above. The pair of spin mops 12 may include a left spin mop 41*a* and a right spin mop 41*b* (FIG. 12). As shown in FIG. 12, the pair of spin mops 12 are provided to rotate about rotation axes Osa and Osb which extend substantially in an up-down direction.

The pair of spin mops 12 may be provided at a lower side of the body 10 in front of the water tank 200.

<Water Tank Housing>

Figure 1B:
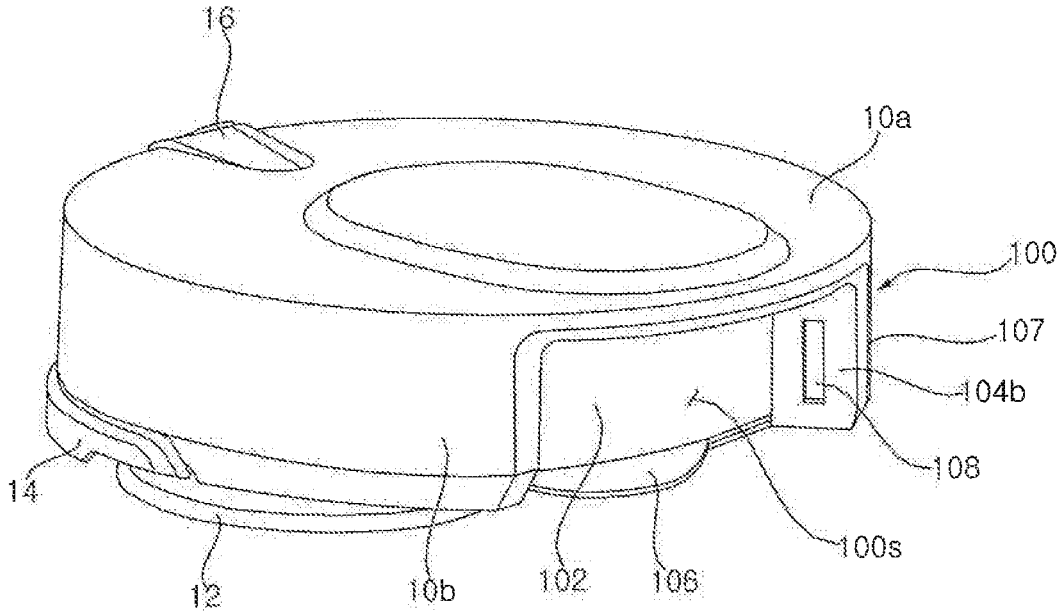
FIG. 1B is a rear perspective view of the robot cleaner of FIG. 1A, from which a water tank is excluded.

Hereinafter, a water tank housing or dock 100 according to an embodiment of the present disclosure will be described with reference to FIGS. 1B and 5.

The body 10 may include a water tank housing or recess 100 provided at the rear of the body 10 and forming a mounting space 100*s* in which the water tank 200 is mounted. The water tank housing 100 may be integrally formed with the body 10. Alternatively, the water tank housing 100 may be provided separately from the body 10 and later combined. The mounting space 100*s* may have a shape or inner contour corresponding to an outer shape or contour of the water tank 200 so that the water tank 200 may be mounted and/or fitted in the mounting space 100*s*.

For example, the water tank housing 100 may be formed by recessing a side surface 10*b* of the body 30 at a rear such that when the water tank 200 is coupled to the water tank housing 100, at least one surface of the water tank 200 may be exposed to the outside of the robot cleaner 1. In this case, the exposed surface of the water tank 200 may be flush with or define a portion of the side surface 10*b* of the body 30.

Further, the water tank housing 100 may be formed as a space or recess of the body 10 such that the body 10 may have an opening or recess the side surface 10*b* and the lower side of the body 30. The opened space at the lower side of the body 30 may expose a handle 260 (FIG. 7) of the water tank 200.

The water tank housing 100 may have a housing front surface 102, a first housing side surface 104*a*, a second housing side surface 104*b*, a housing upper surface, and a housing lower surface 106.

The housing front surface 102 may contact or be provided closest to the water tank 200 when the water tank 200 is mounted in the water tank housing 100. The housing front surface 102 may face the front opening of the water tank housing 100 and define a surface which intersects a front-rear direction and is in parallel with an up-down direction and a left-right direction.

The first housing side surface 104*a* and the second housing side surface 104*b* form surfaces facing both side surfaces of the water tank 200, and guide the water tank 200 when the water tank 200 is inserted into or withdrawn from the water tank housing 100. Front ends of the first housing side surface 104*a* and the second housing side surface 104*b* define portions of edges 104*c* of the opening of the water tank housing 100. Rear ends of the first housing side surface 104*a* and the second housing side surface 104*b* are connected to the housing front surface 102. The first housing side surface 104*a* and the second housing side surface 104*b* may intersect with the housing front surface 102 at the rear ends. The front ends of the first housing side surface 104*a* and the second housing side surface 104*b* may be connected to the side surface 10*b* of the body 30 to define the edges 104*c* of the opening of the water tank housing 100. The edges 104*c* may have a corner shape.

The housing upper surface may face an upper surface of the water tank 200 when the water tank 200 is mounted in the water tank housing 100. The housing upper surface may cover the top of the water tank 200 when the water tank 200 is mounted in the water tank housing 100.

The housing lower surface 106 may support the water tank 200 when the water tank 200 is mounted in the water tank housing 100. The housing lower surface 106 may have a width smaller than the housing upper surface and smaller than the width of the water tank 200 such that when the water tank 200 is mounted in the water tank housing 100, the handle 260 (FIG. 7) of the water tank 200 may be exposed.

Figure 7:
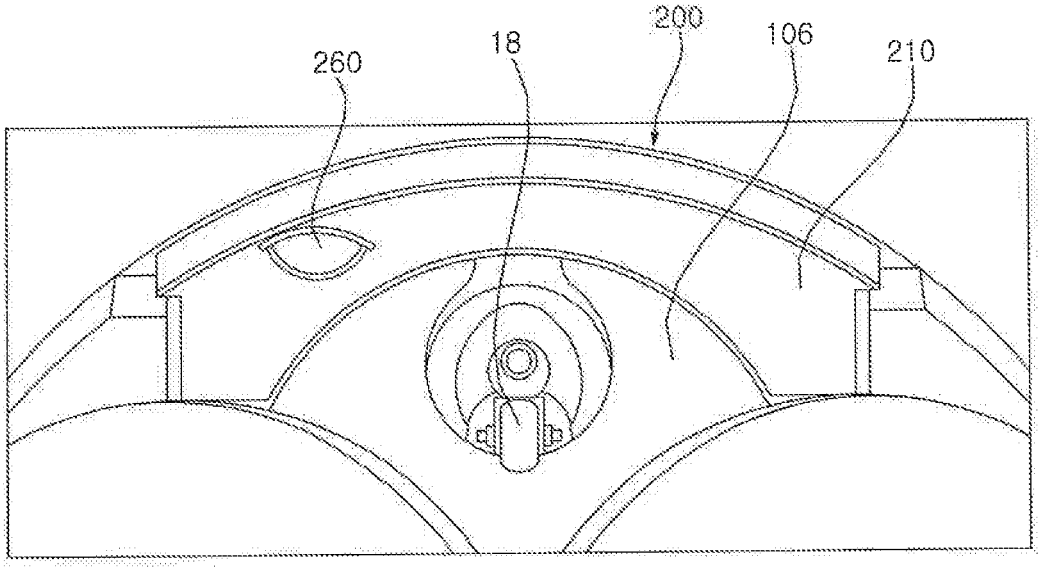
FIG. 7 is a bottom view of a water tank mounted in a water tank housing, according to an embodiment of the present disclosure.

The housing front surface 102, the first housing side surface 104*a*, the second housing side surface 104*b*, the housing upper surface, and the housing lower surface 106 form the mounting space 100*s* in which the water tank 200 is mounted. The water tank housing 100 may have a front opening facing the housing front surface 102 (through which the water tank 200 may be slid or insertion) and may have an opening in the housing lower surface 106 to expose the handle 260 (FIG. 7).

When the water tank 200 is mounted in the water tank housing 100, the front surface of the water tank 200 may contact or alternatively be closely adjacent to (but slightly spaced apart from) the housing front surface 102, and a discharge nozzle 230 of the water tank 200 may be connected to the supply nozzle 110 of the water tank housing 100. The discharge nozzle 230 which will be described later.

The supply nozzle 110 may be provided at the housing front surface 102 and be connected to the water tank 200 when the water tank 200 is mounted in the water tank housing 100. The supply nozzle 110 may be spaced apart from a center of the water tank 200 in a first direction so as to be biased toward a left or right side. As shown in the figures, the supply nozzle 110 may be provided at a left of the center of the water tank 200 to be biased toward the first housing side surface 104*a* from the housing front surface 102.

The supply nozzle 110 may include an insertion part or protrusion 112 having an insertion space 112*s* therein for the discharge nozzle 230 of the water tank 200, a connection nozzle 120 having a hollow inner space and extending forward from the center of the insertion part 112, a pressing nozzle 122 having a hollow inner space and extending rearward from the center of the insertion part 112 toward the water tank 200, and an insertion part sealer or gasket 130 provided in the insertion space 112*s* and pressed against the discharge nozzle 230 when inserted into the insertion space 112*s*.

The insertion part 112 may protrude forward from the housing front surface 102 into the body 10 and forms the insertion space 112*s* inside the insertion part 112. The insertion part 112 may have an inner or circumferential surface 114 protruding forward from the housing front surface 102 and forming the insertion space 112*s*, which may have a cylindrical or annular shape, and an insertion part front surface or an end surface 116 provided at an end portion of the circumferential surface 114.

The pressing nozzle 122 may be provided inside the insertion space 112*s* (e.g., at a middle or center position).

The insertion part sealer 130 may be provided in the insertion space 112*s* between the pressing nozzle 122 and the inner circumferential surface and, when the discharge nozzle 230 is inserted, pressed against the discharge nozzle 230, thereby preventing water supplied from the discharge nozzle 230 from leaking to an outside of the robot cleaner 1.

The insertion part sealer 130 may be provided along or around an outer circumferential surface of the pressing nozzle 122. The insertion part sealer 130 may include an end or front contact surface 132 (FIG. 5) provided at the insertion part end surface 116 to come into contact with an end portion of an insertion nozzle 232 (see also FIGS. 3-4) of the discharge nozzle 230, a pressing nozzle contact surface 134 connected to the end contact surface 132 and extending along or around the outer circumferential surface of the pressing nozzle 122, and at least one contact protrusion or fin 136*a* and/or 136*b* protruding outward from the pressing nozzle contact surface 134 in the insertion space 112*s*.

The contact protrusions 136*a* and 136*b* protrude from the pressing nozzle contact surface 134 toward the insertion part front surface 116 in a hopper or slanted shape. The contact protrusions 136*a* and 136*b* may include a first contact protrusion 136*a* provided at the end portion of the pressing nozzle contact surface 134 and a second contact protrusion 136*b* interposed between the first contact protrusion 136*a* and the end contact surface 132.

The connection nozzle 120 may protrude forward from the insertion part front surface 116 and may be connected to a supply hose provided inside the body 10. The pressing nozzle 122 may protrude rearward from the insertion part end surface 116 and press against one side of a discharge port valve 234 when the water tank 200 is mounted in the water tank housing 100. The pressing nozzle 122 and the connection nozzle 120 are provided in a front-rear direction and have hollow inner portions or spaces which communicate with each other.

The pressing nozzle 122 protrudes rearward of the front surface 102 of the water tank housing 200. A spacing protrusion 124 may be provided at an end portion of the pressing nozzle 122 to protrude rearward toward the discharge nozzle 230. A plurality of spacing protrusions 124 may be spaced apart at a rear end or tip of the pressing nozzle 122. Accordingly, even when the pressing nozzle 122 is contact with the discharge port valve 234, the hollow inner space of the pressing nozzle 122 may not be blocked.

A body-side fixing member 140 to fix or maintain the arrangement of the water tank 200 when mounted may be provided at the water tank housing 100. The body-side fixing member 140*a* and a corresponding water tank-side fixing member 254*a* may be collectively referred to as a fixing unit.

The body-side fixing member 140*a* may be configured to align with or face the water tank-side fixing member 254*a* when the water tank 200 is mounted. The body-side fixing member 140 may be provided at the housing front surface 102 at a position closer to the first housing side surface 104*a* than the second housing side surface 104*b*.

In order to maintain a coupling force between the supply nozzle 110 and the discharge nozzle 230, the body-side fixing member 140*a* may be provided to be adjacent to the supply nozzle 110. The body-side fixing member 140*a* may have a ring shape provided at or around the circumference of the insertion part 112. The body-side fixing member 140 may be a permanent magnet generating a magnetic force. A rare earth magnet having a strong magnetic force may also be used as the body-side fixing member 140*a*. Alternatively, the body-side fixing member 140 may be a metal or ferromagnetic material, and the water tank-side fixing member 254*a* may be a magnet configured to couple to the metal of the body-side fixing member 140. The water-tank side fixing member 254*a* may be a magnet (e.g., permanent magnet) having a polarity opposite to a polarity of the body-side fixing member 140 so as to be attracted to the body-side fixing member 140, or alternatively may be a ferromagnetic material configured to couple to the magnet of the body-side fixing member 140.

Referring to FIG. 7, an auxiliary wheel 18 to support a rear portion of the body 30 may be provided below the housing lower surface 106.

<Water Tank>

Figure 2:
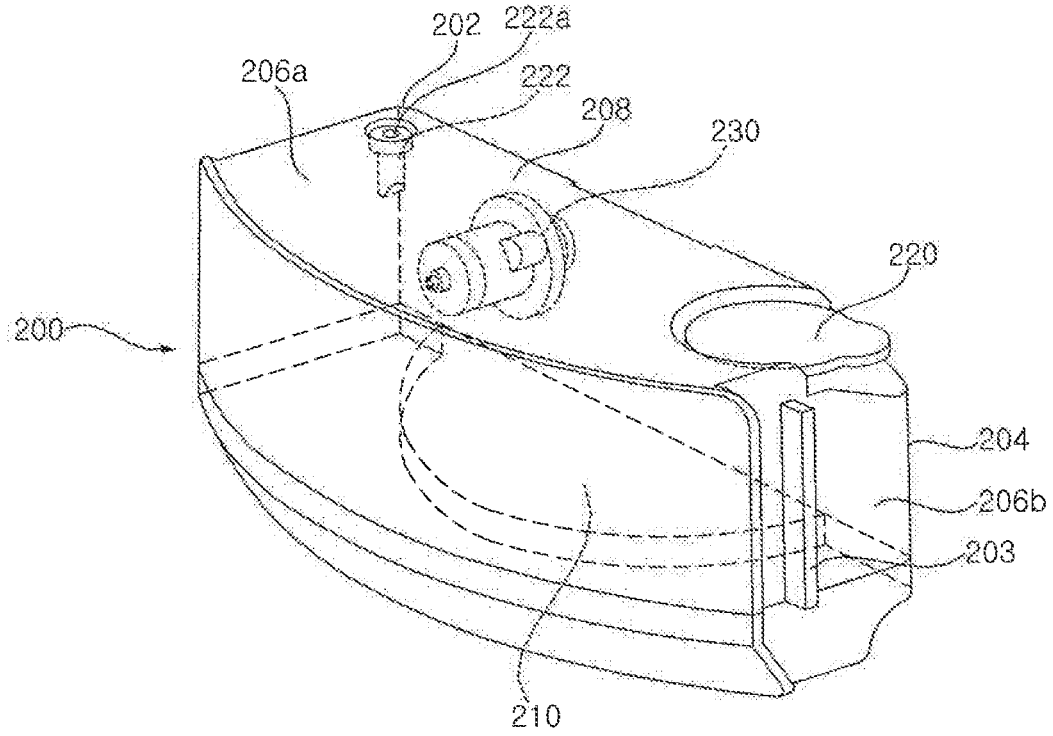
FIG. 2 is perspective view of a water tank according to an embodiment of the present disclosure.

Hereinafter, the water tank 200 according to an embodiment of the present disclosure will be described with reference to FIGS. 2, 3 and 5.

The water tank 200 may include a water tank case 202 forming a space to store water, an opening cover or cap to open or close an opening formed at an upper side of the water tank case 202, the discharge nozzle 230 configured to connect to the supply nozzle 110, and the water tank-side fixing member 254*a* to maintain a mounting of the water tank 200 in the water tank housing 100. The water tank-side fixing member 254*a* may correspond to and align with the first body-side fixing member 140*a*.

The water tank case 202 may have a shape corresponding to the mounting space 100*s* formed by the water tank housing 100. Accordingly, the water tank case 202 may be inserted into or withdrawn from the mounting space 100*s* formed by the water tank housing 100.

The water tank case 202 may include a case front surface 204 configured to face the housing front surface 102 of the water tank 100*a* first case side surface 206*a* and a second case side surface facing the first housing side surface 104*a* and the second housing side surface 104*b*, respectively, a case upper surface 208 configured to face the housing upper surface, a case lower surface 210 configured to face the housing lower surface 106, and a case rear surface 212 provided at the rear side and exposed to an outside.

An opening may be formed at the upper side of the water tank case 202 to supply water into the inside of the water tank case 202. An opening cover or cap 220 may open or close the opening. The opening cover 220 may alternatively be referred to as a lid. The opening cover 220 may be provided at the case upper surface 208 where the opening is formed.

An air passage 222*a* through which the inside or interior and outside or exterior of the water tank 200 may communicate with each other is formed at the upper side of the water tank case 202. The air passage 222*a* may be formed at a separate passage member 222 mounted at the upper side of the water tank case 202. The passage member 222 having the air passage 222*a* may be provided at the case upper surface 208.

The air passage 222*a* may be formed at the case upper surface 208. The case upper surface 208 may be spaced apart from the housing upper surface by a predetermined distance when the water tank 200 is mounted in the water tank housing 100. Accordingly, even when water in the water tank 200 is discharged through the discharge nozzle 230 while the water tank 200 is mounted, external air may be drawn into the water tank 200 through the air passage 222*a*.

The discharge nozzle 230 may be provided at the case front surface 204. The discharge nozzle 230 may be biased to the left side or to the right side on the case front surface 204. The discharge nozzle 230 according to an embodiment of the present disclosure is biased to the left side of the case front surface 204 to align with the supply nozzle 110. A connection hose fixing member 262, which will be described below, may be biased to the same side as the discharge nozzle 230 (i.e., the left side) on the case lower surface 210 such that a length of the connection hose extending between the discharge nozzle 230 and the connection hose fixing member 262 may be minimized.

The discharge nozzle 230 may include the insertion nozzle 232 inserted into the insertion space 112*s*, a discharge port 232*a*, which is open to the front side, provided at a front of the insertion nozzle 232, a discharge port valve 234 provided behind the insertion nozzle 232 to open or close the discharge port 232*a* by moving forwards and backwards, an elastic member or spring 236 applying an elastic force to the discharge port valve 234 in one direction (e.g., a forward direction), and a nozzle housing 240 mounted into the water tank case 202 and forming a space to mount the discharge port valve 234.

The insertion nozzle 232 may have a cylindrical shape and protrude forward from the case front surface 204. The insertion nozzle 232 may be inserted into the insertion space 112*s* when the water tank 200 is mounted to be provided between the pressing nozzle 122 and the insertion part circumferential surface 114 and be pressed against the insertion part sealer 130.

The discharge port valve 234 may be provided in an inner space formed by the nozzle housing 240 to move forwards and backwards. The discharge port valve 234 may include a first surface 234*a* pressed against the pressing nozzle 122 when the water tank 200 is mounted, a second surface 234*b* spaced apart rearward from the first surface 234*a* and coming into contact with an internal sealer 250 to restrict forward movement of the discharge port valve 234, and at least one guide protrusion 234*c* protruding rearward from the second surface 234*b* and moving along a valve moving guider or guide 246 formed at the nozzle housing 240.

A diameter 234*a*D of the first surface 234*a* may be smaller than a diameter 234*b*D of the second surface 234*b*. The first surface 234*a* may be spaced apart forward from the second surface 234*b*. The diameter 234*a*D of the first surface 234*a* may be smaller than a diameter 250D of an inner circumferential surface of the internal sealer 250. The diameter 234*b*D of the second surface 234*b* is greater than the diameter 250D of the inner circumferential surface of the internal sealer 250. The second surface 234*b* may come into contact with the elastic member 236. Accordingly, when a force is not applied separately to the discharge port valve 234 to compress the elastic member 236, the discharge port valve 234 may move forward by a restoring force of the elastic member 236. When a force is not applied separately to the discharge port valve 234, the discharge port valve 234 comes into contact with the internal sealer 250 by the elastic force of the elastic member 236.

Figure 4:
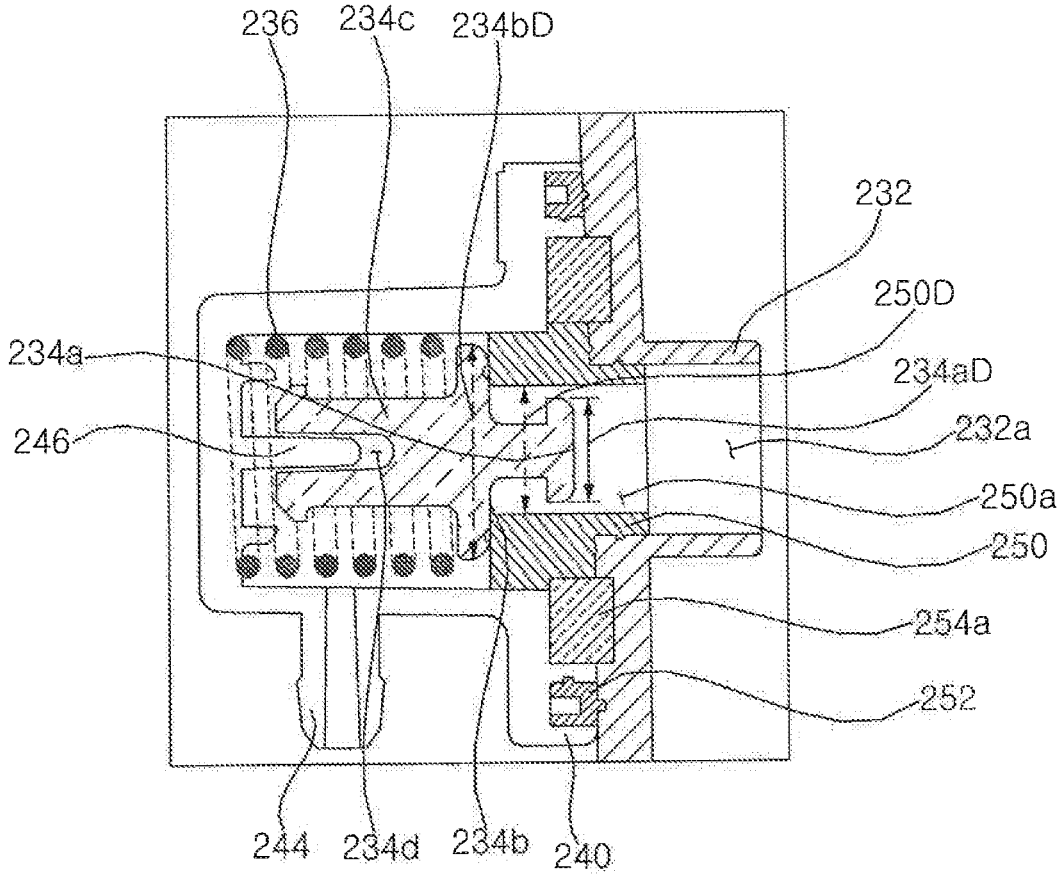
FIG. 4 is a cross-sectional view of a discharge nozzle of a water tank, taken in an up-down direction according to an embodiment of the present disclosure.

The guide protrusion 234*c* protrudes rearward from the second surface 234*b*. Referring to FIG. 4, the discharge port valve 234 includes a pair of guide protrusions 234*c* in an up-down direction. A guide groove 234*d*, in which the valve moving guider 246 is provided, may be formed between the pair of guide protrusions 234*c*.

The nozzle housing 240 may be mounted into the inside of the water tank case 202. The nozzle housing 240 may be fixed to the inside of the water tank case 202 via a separate coupling member 242, which may be a boss or screw.

Referring to FIG. 4, the nozzle housing 240 may have an internal nozzle 244 protruding to the inner space of the water tank 200. The internal nozzle 244 may protrude downward from the nozzle housing 240. A separate connection hose extending to the case lower surface 210 may be connected to the internal nozzle 244. The connection hose fixing member 262 for fixing the other end of the connection hose may be provided at the case lower surface 210.

The nozzle housing 240 may include the valve moving guider 246, protruding forward from a rear surface of the nozzle housing 240 and guiding the movement of the discharge port valve 234. The valve moving guider 246 may be provided into the guide groove 234*d* formed at the discharge port valve 234. As the valve moving guider 246 is inserted into the guide groove 234*d*, the discharge port valve 234 may move forward and backward.

A plurality of sealers 250, 252 are provided between the nozzle housing 240 and an inner surface of the water tank 200. The plurality of sealers 250, 252 may include an internal sealer 250 and an external sealer 252 provided between the nozzle housing 240 and the inner surface of the water tank 200. The internal sealer 250 may be provided at a portion where the discharge port 232*a* is formed, and the external sealer 252 may be provided on an outer circumferential surface of the nozzle housing 240.

The internal sealer 250 may be provided at the water tank case 202 having the discharge port 232*a* and restrict the movement of the discharge port valve 234 moving forward and backward. When the water tank 200 is not mounted in the water tank housing 100, the discharge port valve 234 is pressed against the internal sealer 250. The internal sealer 250 may have a ring shape. The internal sealer 250 may have a sealer opening 250*a* formed at the center thereof and communicating with the discharge port 232*a*.

The external sealer 252 may have a greater radius than the internal sealer 250 and spaced apart from the internal sealer 250 in a radial direction. The external sealer 252 may have an annular shape. The water tank-side fixing member 254*a* may be interposed between the internal sealer 250 and the external sealer 252. Accordingly, the internal sealer 250 and the external sealer 252 may prevent water from flowing into or toward the water tank-side fixing member 254*a* provided between the internal and external sealers 250 and 252 to prolong a life of the water tank-side fixing member 254*a*.

As previously described, the water tank-side fixing member 254*a* may generate a magnetic force (or alternatively be made of a magnetic material) to correspond to the body-side fixing member 140*a*. The water tank-side fixing member 254*a* may be provided between the nozzle housing 240 and the inner surface of the water tank 200 and between the external sealer 252 and the internal sealer 250.

The water tank-side fixing member 254*a* may be provided at the case front surface 204. When the water tank 200 is mounted in the water tank housing 100, the water tank-side fixing member 254*a* may be provided adjacent to the body-side fixing member 140*a*.

As the water tank-side fixing member 254*a*, a permanent magnet generating a magnetic force may be used. Further, a rare earth magnet having a strong magnetic force may also be used as the water tank-side fixing member 254*a*.

Referring to FIG. 7, the water tank 200 may have a handle 260 provided at one side of the water tank case 202 and have a shape which allows a user to easily hold the water tank 200 when the user draws out the water tank 200 mounted in the water tank housing 100. Referring to FIG. 7, the handle 260 may be provided at the case lower surface 210 and may be biased toward a same side where the body-side and water tank-side fixing members 140*a* and 254*a* are provided (e.g., a left side) from the center of the case lower surface 210 so that the user may pull the handle 260 close to where the water tank 200 and the water tank housing 100 are magnetically coupled.

As the handle 260 may be formed at a position biased to the left from the center of the case lower surface 210, torque may be provided easily to rotate the water tank 200 in one direction when a user pulls the handle 260.

The fixing unit or assembly (i.e., the body-side fixing member 140*a* and the water tank-side fixing member 254*a*) generating a magnetic force provides a coupling force between the water tank housing 100 and the water tank 200 and is spaced apart from the center of the water tank 200 in the first direction (i.e., to the left).

A separation prevention unit may limit forward and backward movement of the water tank 200 in the mounting space 100*s*. The separation prevention unit may be spaced apart from the center of the water tank 200 in a direction opposite the first direction (i.e., to the right). The separation prevention unit and the fixing unit may be provided at opposite sides relative to a left-right center of the water tank 200. Accordingly, the separation prevention unit may supplement a weakened coupling strength at a second side of the water tank 200 due to the fixing unit provided at a first side of the water tank 200. Further, as will be described below, the separation prevention unit may provide a center of rotation of the water tank 200 when the water tank 200 is initially separated or withdrawn from the water tank housing 100. The fixing unit having the body-side fixing member 140 and the water tank-side fixing member 254*a* may alternatively be referred to as a magnetic coupler, while the separation prevent unit may alternatively be referred to as a mechanical coupler.

Figure 3:
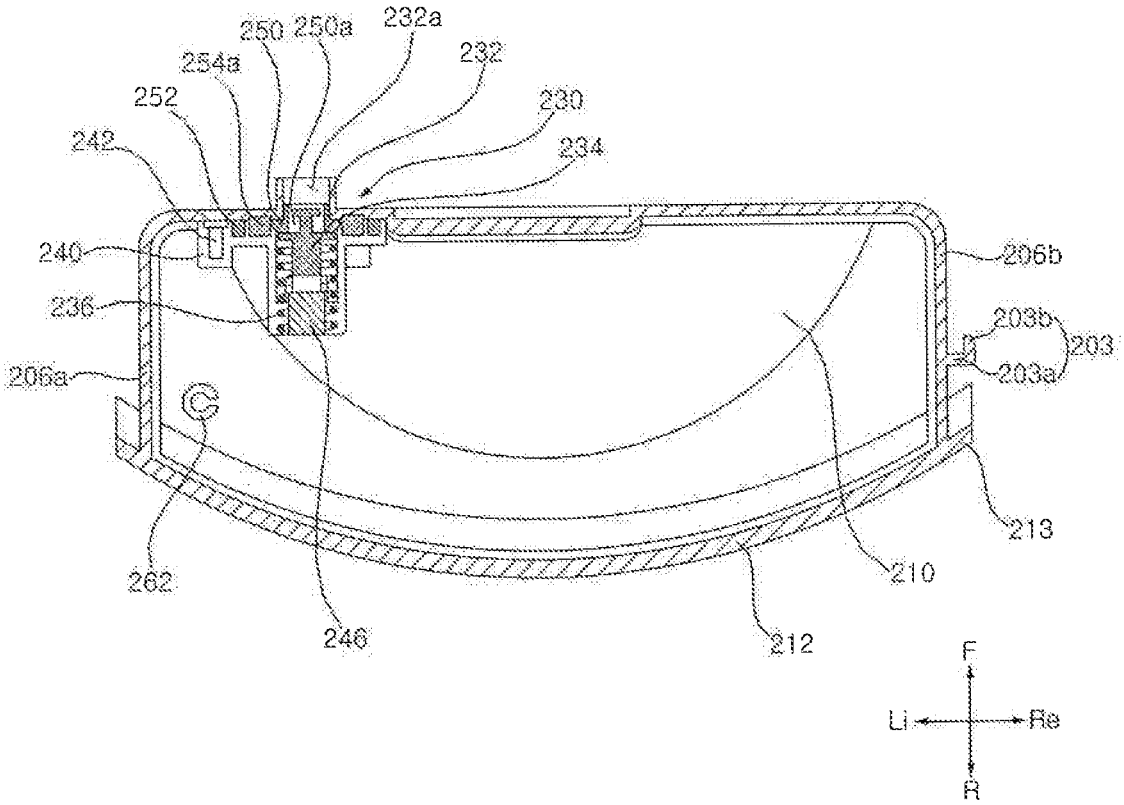
FIG. 3 is a cross-sectional view of a water tank, taken in a left-right direction according to an embodiment of the present disclosure.
Figure 5:
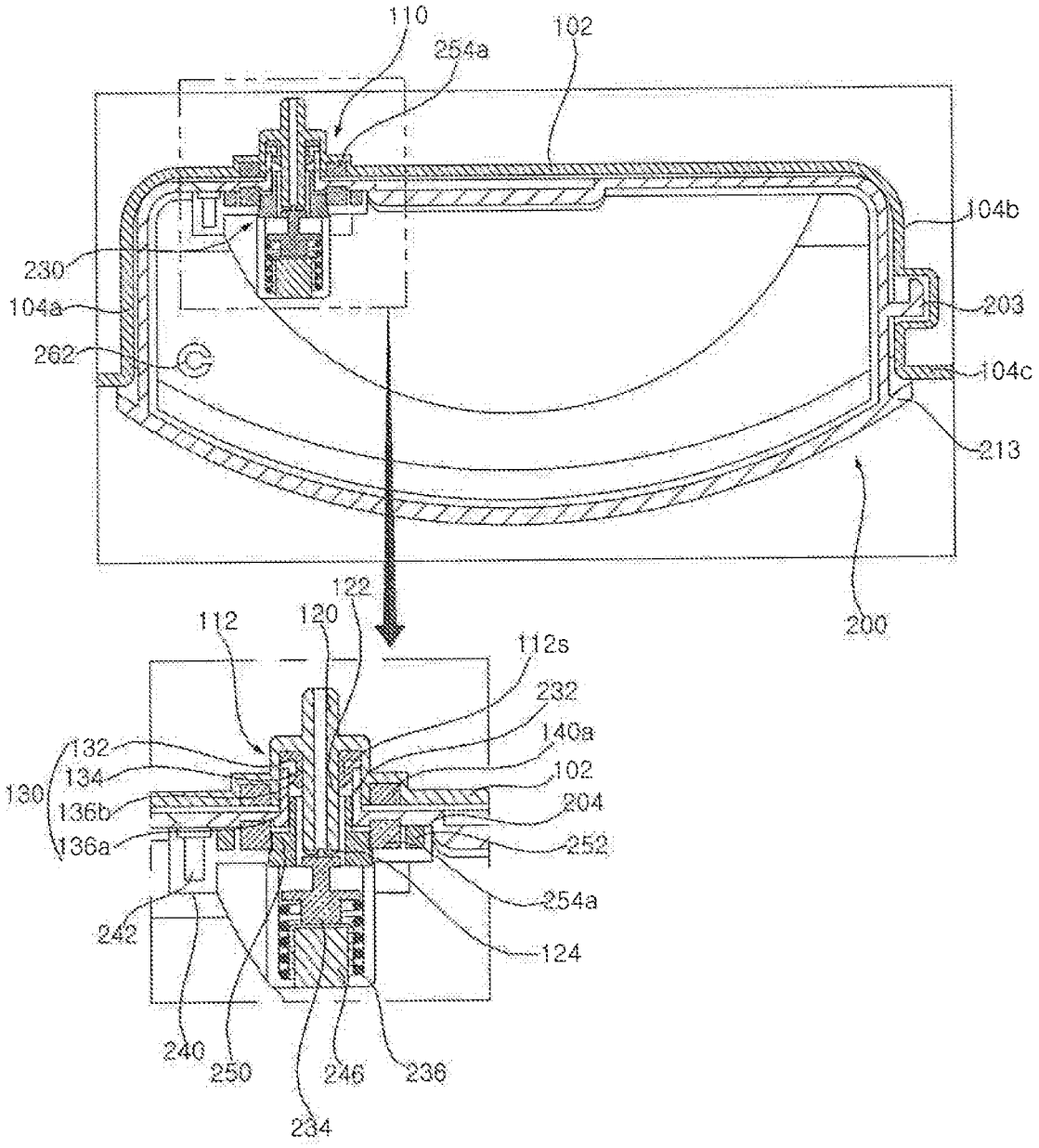
FIG. 5 is a cross-sectional view of a water tank mounted in a water tank housing, taken in a left-right direction according to an embodiment of the present disclosure.
Figure 6:
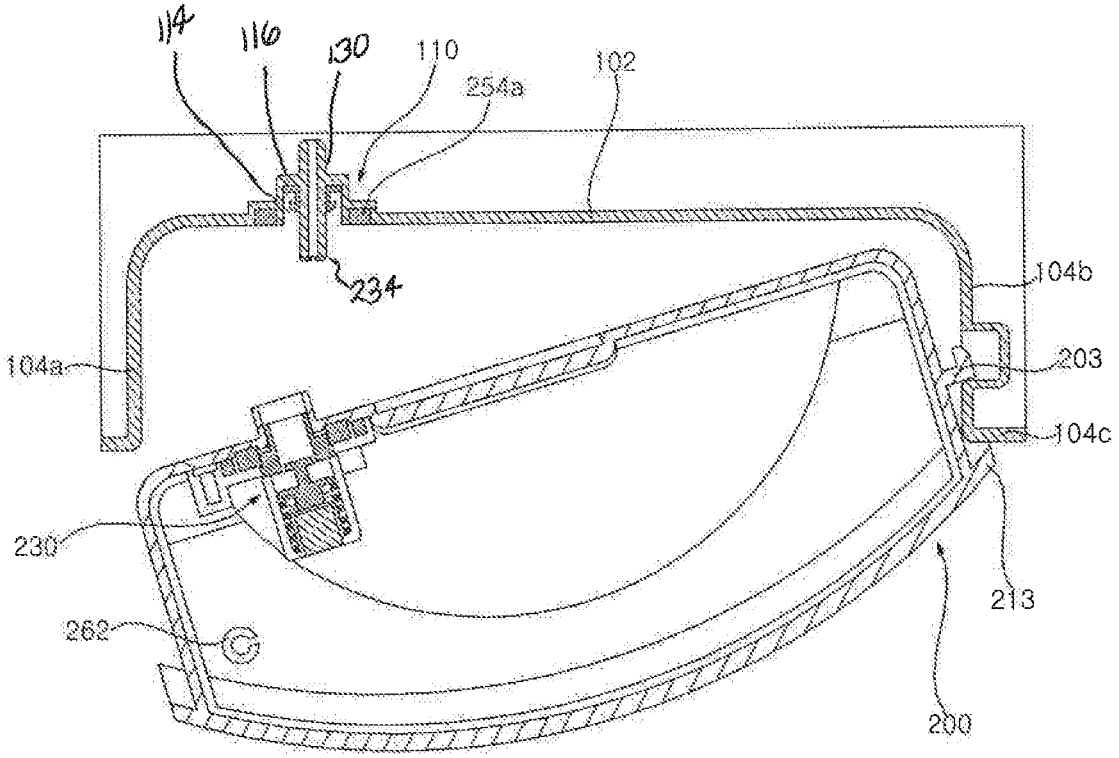
FIG. 6 is a diagram illustrating the water tank of FIG. 5 which is separated from the water tank housing.

For example, referring to FIGS. 3 and 5-6, the separation prevention unit may include a separation prevention rib 203 provided at one of the water tank 200 or the water tank housing 100 and a separation prevention groove 108 provided at the other of the water tank 200 or the water tank housing 100 and configured to receive the separation prevention rib 203. However, the separation prevention unit may have another structure, as will be described below.

The following description will be given based on a structure in which the separation prevention rib 203 is provided at the water tank 200 and the separation prevention groove 108 is formed in the water tank housing 100, but embodiments described herein are not limited. The separation prevention rib 203 may protrude outward from the second case side surface 206*b* to have a shape extending rightward from the second case side surface 206*b*. The separation prevention groove 108 may be formed in the second housing side surface 104 to be recessed rightward.

However, if the separation prevention groove 108 has a size similar to that of the separation prevention rib 203, it may be difficult for the separation prevention rib 203 to be connected to or separated from the separation prevention groove 108 when the water tank 200 rotates. Further, if a width in a front-rear direction of the separation prevention groove 108 is greater than a width of the separation prevention rib 203, a forward and rearward movement of the water tank 200 may not be restricted when the water tank 200 is connected to the water tank housing 100.

In order to solve the above problems, the separation prevention rib 203 may have a first portion 203*a* and a second portion 203*b*. The first portion 203*a* may extend from the second case side surface 206*b* in a direction intersecting the second case side surface 206*b* (i.e., a left-right direction), and the second portion 203*b* may be perpendicularly bent from the first portion 203*a* to extend in a forward-rear direction. The separation prevention rib 203 may protrude rightward and may be bent forward.

A length of the first portion 203*a* in the front-rear direction may be smaller than a length of the second portion 203*b* in the front-rear direction, and may be smaller than the front-rear width of the separation prevention groove 108. When the water tank 200 is connected to the water tank housing 100, the second portion 203*b* may limit the forward and backward movement of the water tank 200, and when the water tank 200 is rotated counterclockwise by the user at the handle 260 to be separated from the water tank housing 100, the first portion 203*a* having a smaller length allows the separation prevention rib 203 to be easily separated from the separation prevention groove 108.

Further, when the water tank 200 is connected to the water tank housing 100 to be mounted, the first portion 203*a* also allows the separation prevention rib 203 to be easily inserted into the separation prevention groove 108. An end of the second portion 203*b* may be inclined or tapered so as to further facilitate rotation and separation of the water tank 200.

The separation prevention groove 108 may be formed at the second housing side surface 104*b* to define a space in which a portion of the water tank 200 is locked via the separation prevention rib 203. A length of the separation prevention groove 108 in the left-right direction may be greater than a length of the separation prevention rib 203 in the left-right direction. The width of the separation prevention groove 108 in the front-rear direction may be greater than the width of the first portion 203*a* in the front-rear direction and/or may be greater than or equal to the length of the second portion 203*b* in the front-rear direction.

There is no limitation on the position of the separation prevention groove 108 and the separation prevention rib 203, but in order to facilitate rotation of the water tank 200, the separation prevention groove 108 may be biased toward the edge 104*c* from a front-rear center of the second housing side surface 104*b*. In this case, the separation prevention rib 203 may be biased toward the case rear surface 212 from the second case side surface 206*b*.

Referring to FIG. 6, by rotating or pivoting in a forward or counterclockwise direction about a position adjacent to the separation prevention unit, the water tank 200 may be separated from the water tank housing 100. By rotating in a reverse direction about the position adjacent to the separation prevention unit, the water tank 200 may be connected to the water tank housing 100. Here, the forward direction may be a counterclockwise direction, and the reverse direction may be a clockwise direction, or vice versa.

The water tank 200 may be separated from the water tank housing 100 in such a manner that when a user pulls the handle 260, the water tank-side fixing member 254*a* is separated from the body-side fixing member 140*a*, and the water tank 200 rotates about a position at which an outer surface of the water tank 200 comes into contact with the water tank housing 100.

In this case, the water tank 200 may further include an edge locking portion 213, which may limit inward movement of the water tank 200 when the water tank 200 rotates and create a leverage effect for the water tank 200. The edge locking portion 213 may allow the water tank 200 to rotate about the edge 104*c* of the water tank housing 100 and allow the water tank-side fixing member 254*a* and the body-side fixing member 140*a* to be easily separated from each other.

The edge locking portion 213 and the separation prevention unit may be provided on one same surface or side (e.g., the right side at the second case side 206*b* and the second housing side 104*b*) of the water tank 200 which intersects the surface where the water tank-side fixing member 254*a* is provided.

The edge locking portion 213 may be locked in the opening of the water tank housing 100. The edge locking portion 213 may protrude from a lower end of the second housing side surface 104*b*. The edge locking portion 213 may be inclined upward or forward toward the right side. The edge 104*c* of the water tank housing 100 may be locked between the edge locking portion 213 and the second case side surface 206*b*.

The edge locking portion 213 allows the center of rotation of the water tank 200 to be biased toward a rear right side of the water tank 200 from the outside of the water tank 200, thereby facilitating separation of the water tank 200.

The water tank 200 may be separated from the water tank housing 100 by being rotated, in a forward or counterclockwise direction, about the edge 104*c* of the water tank housing 100 positioned adjacent to the separation prevention unit. The water tank 200 may rotate about the edge 104*c* of the water tank housing 100 as a central axis, in which the edge 104*c* may be defined by connection of the second housing side surface 104*a* and the side surface 10*b* of the body 10. The rotation axis of the water tank 200 may be in parallel with the up-down direction.

In another example, the water tank 200 may rotate about the edge locking portion 213 as a central axis. While being locked on the edge 104*c* of the opening by the edge locking portion 213, the water tank 200 may be rotated in the forward or counter clockwise direction to be separated from the water tank housing 100. While being locked on the edge 104*c* of the opening by the edge locking portion 213, the water tank 200 may be rotated in the reverse direction to be connected to the water tank housing 100.

Second Embodiment

Figure 8:
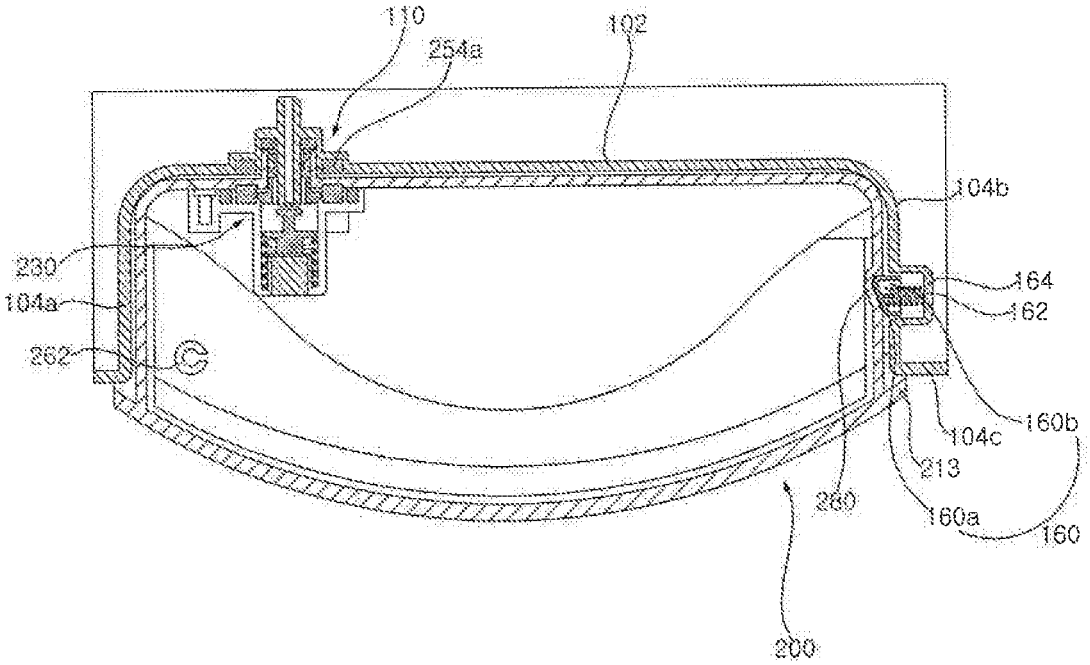
FIG. 8 is a cross-sectional view of a water tank mounted in a water tank housing, taken in a left-right direction according to another embodiment of the present disclosure.

Referring to FIG. 8, a configuration of a water tank 200 and a water tank housing 100 in which the water tank 200 is mounted, will be described below.

The overall configuration of the water tank 200 and the water tank housing 100 illustrated in FIG. 8 may be broadly the same as that described above with reference to FIGS. 1 to 7. Accordingly, the water tank 200 and the water tank housing 100 illustrated in FIG. 8 will be described below based on configurations different from the water tank 200 and the water tank housing 100 described above with reference to FIGS. 1 to 7.

In another embodiment, a configuration of the separation prevention unit is different when compared to the embodiment of FIG. 1.

The separation prevention unit according to another embodiment may include a stopper 160 and a stopper groove 164. The stopper 160 may be provided at the second housing side surface 104*b*. The stopper 160 may have a stopper elastic member 162 or spring having an elastic restoring force in a leftward direction toward the mounting space 100*s*. When external pressure is applied, the stopper 160 may be inserted into the stopper groove 164 formed at the second housing surface 104*b*. The stopper 160 may reciprocate in a direction (left-right direction) intersecting the second housing side surface 104*b*. When there is no external force, the stopper 160 protrudes outside of the stopper groove 164 into the mounting space 100*s* and protrudes inward from the second housing side surface 104*b*.

The stopper 160 may include an inclined surface 160*a* being inclined rearwardly and downwardly (or outward from a front to a rear), and a locking surface 160*b* extending toward the stopper groove 164 in a left-right direction. When no external force is applied, the inclined surface 160*a* and the locking surface 160*b* of the stopper 160 may protrude into the mounting space 100*s*. Accordingly, when the water tank 200 is inserted into the mounting space 100*s*, the water tank 200 comes into contact with the inclined surface 160*a*, such that the stopper 160 may move to the stopper groove 164 and compress the stopper elastic member 162. However, once the water tank 200 is mounted in the water tank housing 100, the stopper 160 may be inserted into the stopper groove 280 via a restoring force of the stopper elastic member 162, and the locking surface 160*b* may prevent the water tank 200 from being withdrawn from the water tank housing 100.

The water tank 200 may be formed with the stopper groove 280 into which the stopper 160 is inserted when the water tank 200 is mounted so as to fix or maintain the arrangement of the water tank 200 in the water tank housing 100. The stopper groove 280 may have a shape corresponding to the inclined surface 160*a* and the locking surface 160*b* of the stopper 160. The stopper groove 264 may be formed at the second case side surface 206*b*.

The stopper 160 may be provided adjacent to the rear end of the second housing side surface 206*b*, and a portion connecting the inclined surface 160*a* and the locking surface 160*b* may be formed in a curved shape.

Figure 9:
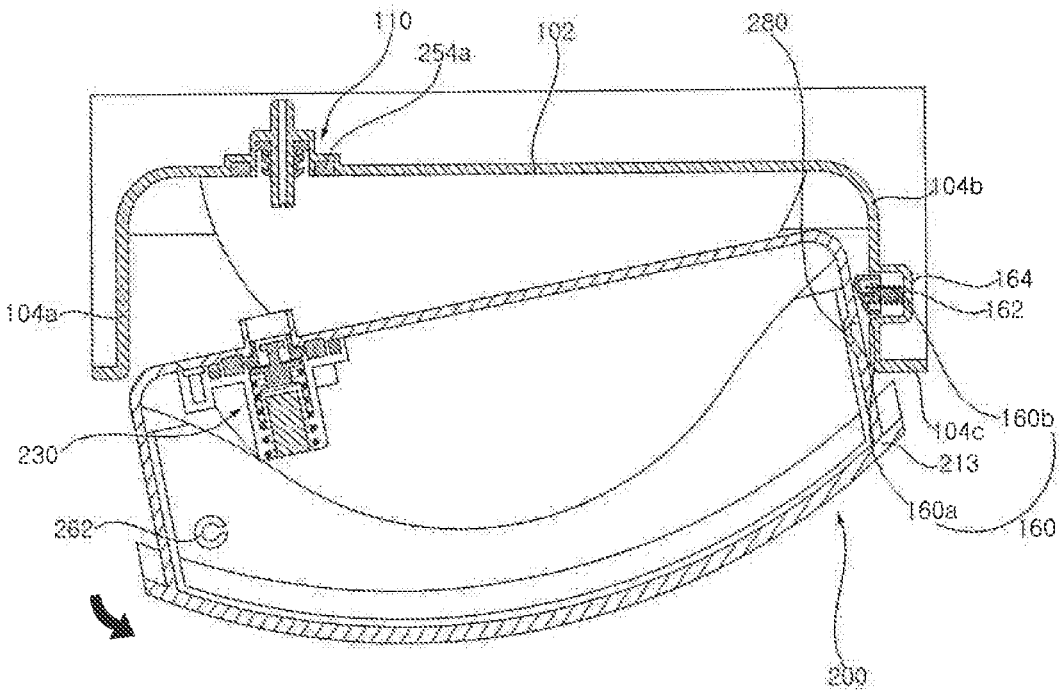
FIG. 9 is a diagram illustrating the water tank of FIG. 8 which is separated from the water tank housing.

Referring to FIG. 9, as illustrated in the embodiment of FIG. 1, the water tank 200 may be separated from the water tank housing 100 by rotating about the edge locking portion 213.

Referring to FIG. 12, first and second spin mops 41*a* and 41*b* in a pair of spin mops 12 may be detachably mounted as a mop module or assembly 40 at the body 10. The mop module 40 may include at least one floor cloth 411 which wipes the floor while rotating. The mop module 40 may include the first and second spin mops 41*a* and 41*b*, but embodiments disclosed herein are not limited to two. The first and second spin mops 41*a* and 41*b*, when viewed from above, may rotate clockwise or counterclockwise while being in contact with the floor. The first and second spin mops 41*a* and 41*b* may be provided adjacent in a left-right direction, and for convenience of description, the first and second spin mops 41*a* and 41*b* may be referred to as left and right spin mops 41*a* and 41*b*, respectively. In the embodiment, the left and right spin mops 41*a* and 41*b* are adapted to rotate about rotary or spin shafts 414 about axes Osa and Osb, respectively, which extend substantially in an up-down direction. The mop module 40 may be provided behind a collecting module.

Each of the left spin mop 41*a* and the right spin mop 41*b* includes the floor cloth 411, a rotary plate 412, a spin shaft 414, a water receiving part or recess 413, and a slave joint 415. The body 10 and the mop module 40 may be detachably coupled to each other. A state in which the body 10 and the mop module 40 are coupled to each other may be referred to as a "coupled state." Further, a state in which the body 10 and the mop module 40 are separated from each other may be referred to as a "separated state."

The robot cleaner 1 includes a detaching module which detachably engages the mop module 40 with the body 10. In the coupled state, the detaching module may release the engagement of the mop module 40 from the body 10. The detaching module operates to allow the mop module 40 and the body 10 to be detachably coupled to each other. In the separated state, the detaching module may allow the mop module 40 to be engaged with the body 10. The detaching module may be provided across a gap between the water tank 200 and a battery.

The robot cleaner 1 may include a base forming a lower surface, a front surface, a rear surface, a left surface, and a right surface of the body 10. The mop module 40 may be coupled to the base. The collecting module may be coupled to the base. A controller and the battery may be provided in an internal space formed by a case and the base, and/or an internal space of the body 10. Further, a mop driving part or motor may be provided at the body 10 to drive a rotation of the spin shafts 414.

The mop module 40 may include a module housing 42 forming an exterior of the mop module 40. The module housing 42 may be provided at a lower side of the body 10. A module cabinet may form an exterior of the collecting module. The module cabinet may be provided at a lower side of the body 10. The module housing 42 and the module cabinet may be spaced apart from each other in the front-rear direction.

Figure 10:
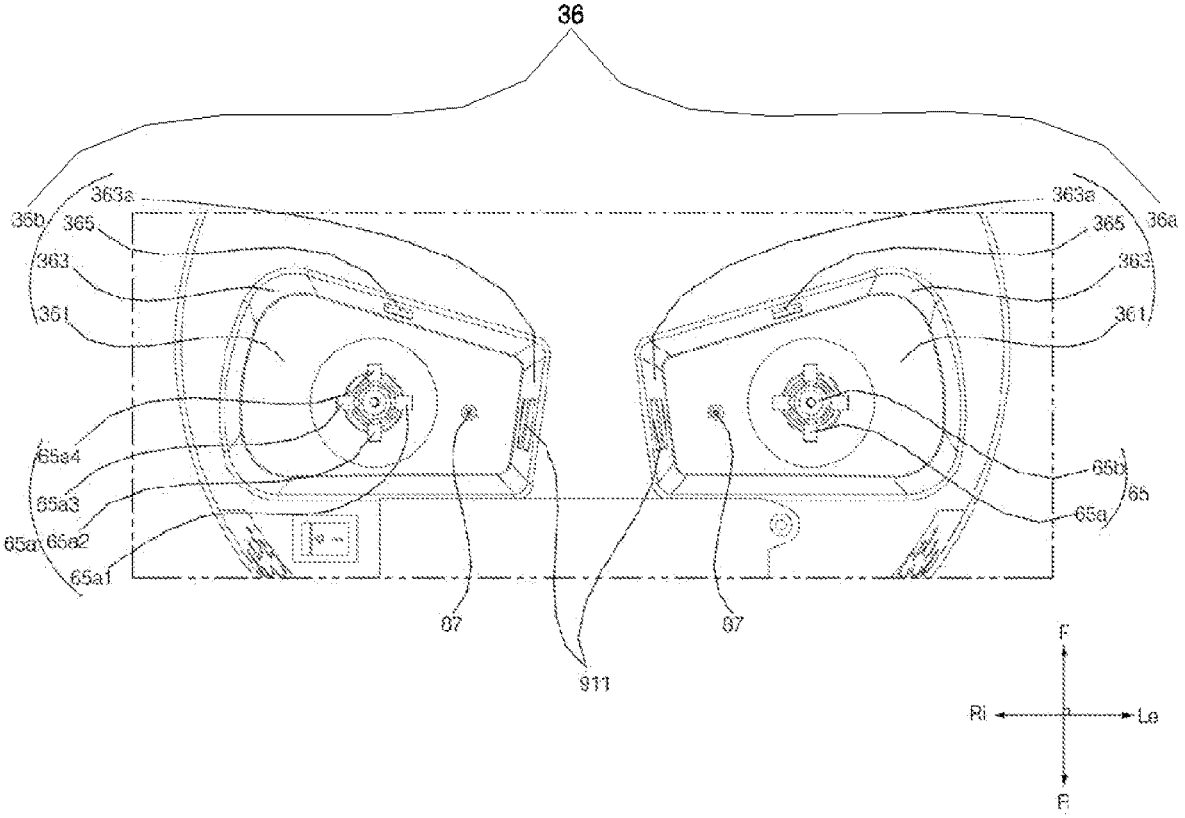
FIG. 10 is a bottom elevation view illustrating a module mounting part of a main body.
Figure 11:
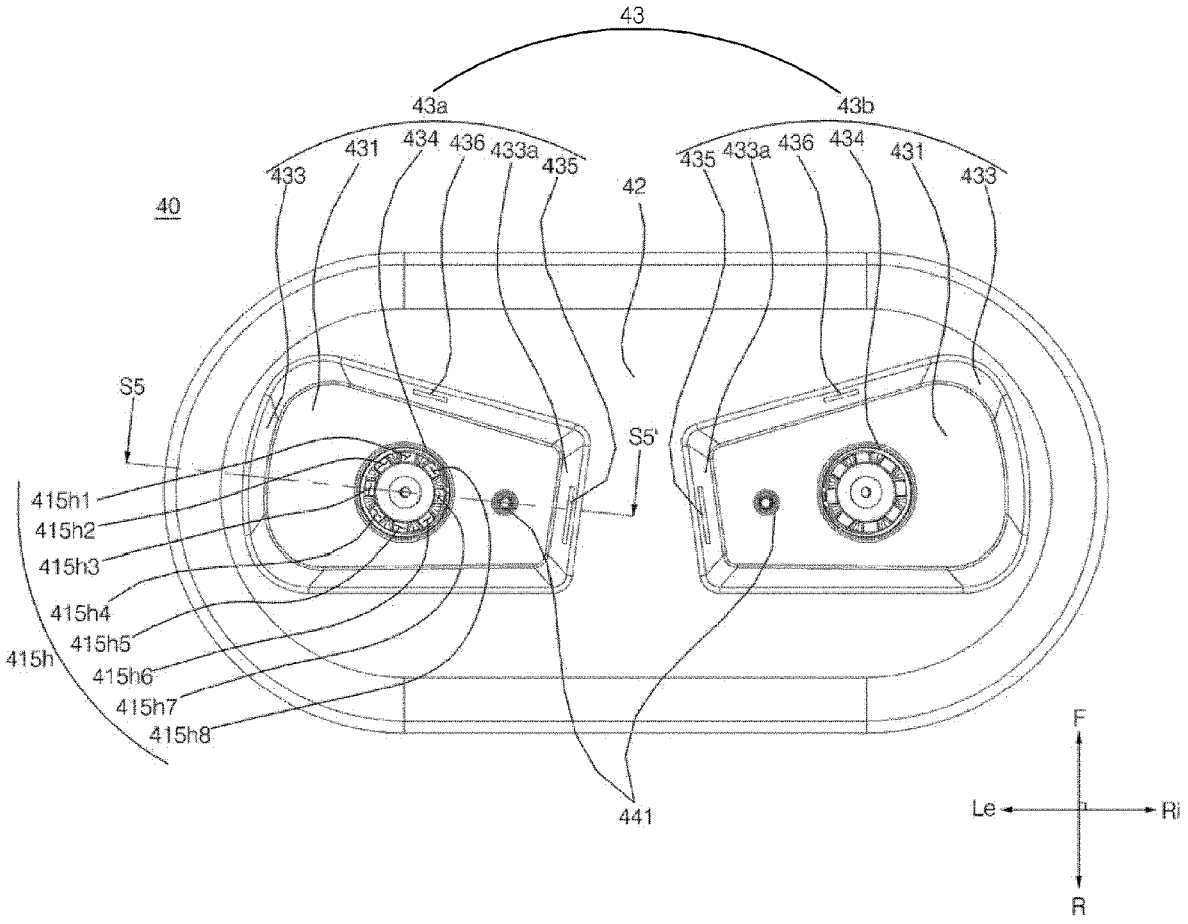
FIG. 11 is a top elevation view of a mop module coupled to the module mounting part of the main body.

Referring to FIG. 10, the body 10 may include a module mounting part or assembly 36, and referring to FIG. 11, the mop module 40 may include a body mounting part or assembly 43. Referring to FIGS. 10 and 11, the body mounting part 43 may be detachably coupled to the module mounting part 36.

The module mounting part 36 may be provided at the lower side of the body 10. The body mounting part 43 may be provided at an upper side of the mop module 40 at an upper surface of the module housing 42.

One of the module mounting part 36 and the body mounting part 43 may protrude in the up-down direction, and the other one of the module mounting part 36 and the body mounting part 43 may be recessed in the up-down direction so that the module mounting part 36 and the body mounting part 43 may be engaged with each other. The drawings show that the body mounting part 43 protrudes upward from the mop module 40 and the module mounting part 36 is recessed upward from the body 10 to be engaged with the body mounting part 43, but embodiments disclosed herein are not limited. For example, the module mounting part 36 may protrude downward to engage with the body mounting part 43, which may be recessed downward.

When viewed from the top, the body mounting part 43 and the module mounting part 36 may have an asymmetric shape in the front-rear direction (across a left-right access). If the mop module 40 is coupled to the body 10 while the front and rear sides of the mop module 40 are inverted, the body mounting part 43 may not be engaged with the module mounting part 36. Accordingly, the body mounting part 43 having an asymmetric shape may allow the mop module 40 and the body 10 to be coupled to each other in a predetermined direction.

The mop module 40 may include a pair of body mounting parts or protrusions 43*a* and 43*b* spaced apart from each other in a left-right direction. The pair of body mounting parts 43*a* and 43*b* may correspond to the pair of spin mops 41*a* and 41*b* and a pair of module mounting parts or recesses 36*a* and 36*b* included in the module mounting part 35.

The pair of module mounting parts 36*a* and 36*b* may be spaced apart from each other in a left-right direction. The pair of module mounting parts 36*a* and 36*b* may correspond to the pair of body mounting parts 43*a* and 43*b*.

The pair of body mounting parts 43*a* and 43*b* may protrude upward from the mop module 40. The pair of module mounting parts 36*a* and 36*b* may be recessed upward to be engaged with the pair of body mounting parts 43*a* and 43*b*.

The module mounting part 36 may include a lower or central surface part 361 forming a lower or recessed surface. In the coupled state described above, the lower surface part 361 may contact an upper or central surface part 431 of the body mounting part 43. The lower surface part 361 may be formed to be a horizontal plane. The lower surface part 361 may be provided at an upper side of a corresponding peripheral part or side wall 363.

The module mounting part 36 may include the corresponding peripheral part 363 provided along the circumference or edge of the lower surface part 361. In the coupled state, the corresponding peripheral part 363 comes into contact with a periphery part or side wall 433 of the body mounting part 43. The corresponding peripheral part 363 may form an inclined surface extending a lower surface of the body 10 and the lower surface part 361. The corresponding peripheral part 363 may have a slope which rises from the lower surface of the body 10 toward the lower surface part 361. The corresponding peripheral part 363 may be provided to surround the lower surface part 361.

The pair of module mounting parts 36 may include a pair of locking surfaces 363*a* inserted into a space between the pair of body mounting parts 43. In the corresponding peripheral part 363 of any one module mounting part 36, the pair of locking surfaces 363*a* may be provided in a region close to the other adjacent module mounting part 36. The locking surfaces 363*a* may be provided in a region which is relatively adjacent to a central perpendicular plane in the corresponding peripheral part 363. The locking surfaces 363*a* may form a portion of the corresponding peripheral part 363.

Referring to FIGS. 10-12, the module mounting part 36 may have a joint hole 364 through which at least a portion of the master joint 65 is exposed. The joint hole 364 may be formed at the lower surface part 361. The master joint 65 may pass through the joint hole 364 and be coupled with the slave joint 415 to transmit a driving force of the mop driving part to the spin mops 41*a* and 41*b*.

Protruding locking portions 911 and 365 may be provided on a surface of any one of the module mounting part 36 and the body mounting part 43, and corresponding locking portions or recesses 435 and 436, being recessed to be engaged with the locking portions 911 and 365 in the coupled state, are provided on a surface of the other one of the module mounting part 36 and the body mounting part 43. The drawings show that the protruding locking portions 911 and 365 may be provided on the peripheral part 363 and locking surface 363*a*, respectively, of the body 10, while the corresponding locking portions 435 and 436 may be formed in the peripheral part 433 and locking surface 433*a*, respectively, of the mop module 40, but embodiments disclosed herein are not limited. Not only may positions of the protruding locking portions 911 and 363, on the one hand, and the corresponding locking portions 435 and 436, on the other hand, may be swapped, any combination of protruding locking portions 911 and 363 and corresponding locking portions 435 and 436 may be provided such that a protruding portion 911 and/or 363 is configured to engage with a corresponding locking portions 435 and/or 436.

The body mounting part 43 may include an upper surface part 431 forming an upper surface. The upper surface part 431 may come into contact with the lower surface part 351 of the module mounting part 36 in the coupled state. The upper surface part 431 may be directed toward the upper side. The upper surface part 431 may be formed to be horizontal or lie along a horizontal plane. The upper surface part 431 may be provided at the upper side of the peripheral part 433.

The body mounting part 43 has the peripheral part 433 provided along the circumference or edge of the upper surface part 431. In the coupled state, the peripheral part 433 comes into contact with the corresponding peripheral part 363 of the module mounting part 36. The peripheral part 433 may form an inclined surface extending toward the upper surface of the module housing 42 and the upper surface part 431. The peripheral part 433 may have a slope which rises from the upper surface of the module housing 42 toward the upper surface part 431. The peripheral part 433 may be provided to surround the upper surface part 431.

Each body mounting part 43*a* and 43*b* may have a corresponding locking surface 433*a* coming into contact with the locking surface 363*a* in the coupled state. The pair of corresponding locking surfaces 433*a* are provided to diagonally face each other on the left and right sides. The pair of corresponding locking surfaces 433*a* may be provided between the pair of body mounting parts 43. In the peripheral part 433 of any one body mounting part 43, the corresponding locking surfaces 433*a* may be provided in a region close to the other adjacent body mounting part 43. The corresponding locking surfaces 433*a* may be provided in a region intersecting a central perpendicular plane or axis S5-S5'. The corresponding locking surfaces 433*a* may form a portion of the peripheral part 433.

The body mounting part 43 may have a drive hole 434 aligning with the joint hole 465 of the module mounting part 36 and through which at least a portion of the slave joint 415 is exposed. The drive hole 434 may be formed at the upper surface part 431. In the coupled state, the master joint 65 may be inserted into the drive hole 434 to be coupled to the slave joint 415.

The corresponding locking portions 435 and 436 may be holes or grooves formed at the surface of the body mounting part 43. The corresponding locking portions 435 and 436 may be provided at the peripheral part 433. A plurality of corresponding locking portions 435 and 436 may be provided, which may correspond to a plurality of locking portions 915 and 365.

The corresponding locking portions 435 and 436 may include a first corresponding locking portion 435 with which the first locking portion 911 may be locked and a second corresponding locking portion 436 with which the second locking portion 365 may be locked. The first corresponding locking portion 435 may be formed at the corresponding locking surface 433*a*. The second corresponding locking part 436 may be formed at the peripheral part 433.

The pair of spin mops 41*a* and 41*b* may be symmetrical to each other with respect to a virtual central perpendicular plane. The left spin mop 41*a* and the right spin mop 41*b* may be bilaterally symmetrical to each other.

A lower surface of the left spin mop 41*a* and a lower surface of the right spin mop 41*b* may be inclined. An overall lower surface of the left spin mop 41*a* may be inclined leftwardly and downwardly. An overall lower surface of the right spin mop 41*b* may be inclined rightwardly and downwardly. The lower surface of the left spin mop 41*a* may have a lowest point on the left side and a highest point on the right side. The lower surface of the right spin mop 41*b* may have a lowest point on the right side and a highest point on the left side.

The robot cleaner 1 may move by a frictional force with a ground surface or floor which is generated by the mop module 40. The mop module 40 may generate "a forward movement frictional force" for moving the body 10 forward, or a "rearward movement frictional force" for moving the body 10 backwards. The mop module 40 may generate a "leftward moment frictional force" for turning the body 10 to the left, or a "rightward moment frictional force" for turning the body 10 to the right. The mop module 40 may generate a frictional force by combining any one of the forward movement frictional force and the rearward movement frictional force with any one of the leftward moment frictional force and the rightward moment frictional force.

In order for the mop module 40 to generate the forward movement frictional force, the left spin mop 41*a* may spin at a predetermined revolutions per minute (rpm) R1 in a first forward direction w1*f* (which may correspond to a first angular velocity direction; i.e., clockwise or counterclockwise), and the right spin mop 41*b* may spin at the predetermined rpm R1 in a second forward direction w2*f* (which may correspond to a second angular velocity direction opposite to the first angular velocity direction; i.e., counterclockwise or clockwise).

In order for the mop module 40 to generate the rearward movement frictional force, the left spin mop 41*a* may spin at a predetermined rpm R2 in a first reverse direction w1*r* (which may be opposite to the first forward direction w1*f*), and the right spin mop 41*b* may spin at the predetermined rpm R2 in a second reverse direction w2*f* (which may be opposite to the second forward direction w2*f*). The first reverse direction w1*r* may be a same direction as the second forward direction w2*f*, and the second reverse direction w2*f* may be a same direction as the first forward direction w1*f*.

The slave joint 415 may rotate while being engaged with the master joint 65. The master joint 65 may be exposed outside of the body 10. At least a portion of the slave joint 415 may be exposed outside of the mop module 40.

In the separated state, the master joint 65 and the slave joint 415 may be separated from each other. In the coupled state, the master joint 65 and the slave joint 415 may be engaged with each other.

Any one of the master joint 65 and the slave joint 415 may have a plurality of driving protrusions 65*a* provided along a circumferential direction with respect to a rotation axis of the any one, and the other one thereof may have a plurality of driving grooves 415*h* provided along a circumferential direction with respect to a rotation axis of the other one. There may be eight driving grooves 415*h*1-415*h*8, but embodiments disclosed herein are not limited.

The plurality of driving protrusions 65*a* may be spaced apart from each other at predetermined intervals. The plurality of driving grooves 415*h* may be spaced apart from each other at predetermined intervals. In the coupled state, the driving protrusions 65*a* may be inserted into the driving grooves 415*h*. In the separated state, the driving protrusions 65*a* may be separated from the driving grooves 415*h*.

Any one of the master joint 65 and the slave joint 415 may have the plurality of driving protrusions 65*a* spaced apart from each other in a circumferential direction with respect to a rotation axis of the any one, and the other one thereof may have a plurality of facing protrusions 415*a* spaced apart from each other in a circumferential direction with respect to a rotation axis of the other one. The plurality of facing protrusions 415*a* protrude in a direction of the any one thereof.

The plurality of facing protrusion 415*a* may be spaced apart from each other at predetermined intervals, and the plurality of driving grooves 415*h* may be provided between facing protrusions 415*a*. In the separated state, the driving protrusion 65*a* may be separated from the two adjacent facing protrusions 415*a*. In the coupled state, at least one of the facing protrusions 415*a* may be provided between two adjacent driving protrusions 65*a*. According to the embodiment of the present disclosure, in the coupled state, two facing protrusions 415*a* may be provided between two adjacent driving protrusions 65*a*.

A protruding end of the facing protrusions 415*a* may be rounded. A protruding end of the facing protrusions 415*a* may be rounded in an arrangement direction of the plurality of facing protrusions 415*a*. The protruding end of the facing protrusions 415*a* may have a rounded corner, which is rounded in a direction of adjacent facing protrusions 415*a* with respect to a central axis of a protruding direction. When the separated state is changed to the coupled state, the driving protrusions 65*a* may be moved smoothly along the rounded protruding end of the facing protrusions 415*a* to be inserted into the driving grooves 415*h*.

The drawings show that the master joint 65 may have the driving protrusions 65*a*, and the slave joint 415 may have the driving grooves 415*h*, but embodiments disclosed herein are not limited. The slave joint 415 may include the facing protrusions 415*a*.

The slave joint 415 may be fixed to an upper end of the spin shaft 414. The slave joint 415 may have a driven shaft 415*b* fixed to the spin shaft 414. The slave joint 415 may have the facing protrusions 415*a* protruding from the driven shaft 415*b*. The facing protrusions 415*a* may protrude from the driven shaft 415*b* toward the master joint 65 in the up-down direction.

The module housing 42 may connect the pair of spin mops 41*a* and 41*b*. By the module housing 42, the pair of spin mops 41*a* and 41*b* may be separated together from the body 10 and may be connected together to the body 10. The body mounting part 43 may be provided at an upper side of the module housing 42. The spin mops 41*a* and 41*b* may be rotatably supported by the module housing 42. The spin mops 41*a* and 41*b* may be provided to pass through the module housing 42.

The module housing 42 may have an upper cover 423 forming an upper part, and a lower cover 421 forming a lower part. The upper cover 423 and the lower cover 421 may be connected to each other to form an inner space which partially accommodates the spin mops 41*a* and 41*b*.

Suspension units 47, 48, and 49 may be provided at the module housing 42. The suspension units 47, 48, and 49 may be provided in the inner space formed by the upper cover 423 and the lower cover 421. The suspension units 47, 48, and 49 may support the spin shaft 414 in a manner that allows the spin shaft 414 to be movable in an up-down direction within a predetermined range. In the embodiment, the suspension units 47, 48, and 49 may have a tilting frame 47, a tilting shaft 48, and an elastic member or spring 49.

The module housing 42 may have a limit, wall, or recess to restrict a rotation range of the tilting frame 47. The limit may include a lower limit or rib 427 to limit a downward rotation range of the tilting frame 47. The lower limit 427 may be provided at the module housing 42. Once the tilting frame 47 rotates downward to the maximum, the lower limit 427 comes into contact with a lower limit contact part 477 of the tiling frame 47. When the robot cleaner 1 is normally provided on an external horizontal plane, the lower limit contact part 477 may be spaced apart from the lower limit 427. As there is no force pushing the lower surface of the spin mop 41*a* or 41*b* upward, the tilting frame 47 may rotate or pivot to a maximum angle and the lower limit contact part 477 may come into contact with the lower limit 427 once an inclination angle is at a maximum.

The limit may include an upper limit or rib to limit an upward rotation range of the tilting frame 47. As the master joint 65 is pressed against the slave joint 415, an upward rotation range of the tilting frame 47 may be limited by the upper limit. When the robot cleaner 1 is normally provided on an external horizontal plane, the master joint 65 may be pressed against the slave joint 41 to a maximum, and an inclination angle may be at a minimum.

The tiling frame 47 may have a first support 475 to support the elastic member 49, and the module housing 42 may have a second support 425 to fix or couple to an end portion of the elastic member 49. When the tilting frame 47 rotates, the elastic member 49 may be elastically deformed or elastically restored by the second support 425 fixed to the module housing 42.

The module housing 42 may have a tilting shaft support 426 to support the tilting shaft 48. The tilting shaft support 426 may support both ends of the tiling shaft 48.

The mop module 40 may include a module water supply part to guide water introduced from the water tank 200 to the spin mops 41*a* and 41*b* in the coupled state described above. The module water supply part may guide water from a top or an upper area to a bottom or a lower area. A pair of module water supply parts may be provided corresponding to the pair of spin mops 41*a* and 41*b*.

The module water supply part may include a corresponding water supply part 441 to receive water from the water tank 200. The corresponding water supply part 441 may be connected to a water supply connection part 87. The corresponding water supply part 441 may have a groove into which the water supply connection part 87 may be inserted. The corresponding water supply part 441 may be provided at the upper surface part 431 of the body mounting part 43. The corresponding water supply part 441 may be formed at a surface of the body mounting part 43 which is recessed downwardly.

The module water supply part may have a water delivery part to guide water introduced into the corresponding water supply part 441 to a water supply guide part 445. The water delivery part protrude downward from an upper inner surface of the upper cover 421 to be below the corresponding water supply part 441. The water delivery part may be provided to allow water to drop down to the water supply guide part 445. The corresponding water supply part 441 and the water delivery part may have holes or channels vertically communicating with each other, and water may fall through the holes.

The module water supply part may include the water supply guide part 445 to guide the water introduced into the corresponding water supply part 441 to the spin mops 41*a* and 41*b*. The water, introduced into the corresponding water supply part 441, may flow into the water supply guide part 445 through the water delivery part.

The water supply guide part 445 may be fixed to a frame base 471 of the tilting frame 47. Water from the corresponding water supply part 441 and the water delivery part may flow into a space or channel formed by the water supply guide part 445 leading to the water receiving part 413 of the spin mops 41*a* and 41*b* to minimize or reduce scattering of water.

The water supply guide part 445 may include an inflow part 445*a* forming a space which is recessed from top to bottom. The inflow part 445*a* may accommodate a lower end portion of the water delivery part. The inflow part 445*a* may form a space having an open upper side. The water, passing through the water delivery part, flows in through the upper opening of the space of the inflow part 445*a*. One side of the space of the inflow part 445*a* may be connected to a flow path at which a flow path part 445*b* is formed.

The water supply guide part 445 may have the flow path part 445*b* connecting the inflow part 445*a* and a discharge part 445*c*. One end of the flow path part 445*b* may be connected to the inflow part 445*a*, and the other end of the flow path part 445*b* may be connected to the discharge part 445*c*. A space formed by the flow path part 445*b* may serve as a water passage, and the flow path part 445*b* may serve as a water guide. The space of the flow path part 445*b* may be connected to the space of the inflow part 445*a*. The flow path part 445 may be formed as a channel having an open upper side. The flow path part 445*b* may have a slope which decreases from the inflow part 445*a* toward the discharge part 445*c*.

The discharge part 445*c* may discharge water into a water supply space of the water receiving part 413. A lower end of the discharge part 445*c* may be provided in the water supply space. The discharge part 445*c* may have a hole connected to an upper space of the rotary plate 412 in an inner space of the module housing 42. The hole of the discharge part 445*c* may vertically connects the two spaces. The discharge part 445*c* may have a hole vertically passing through the tilting frame 47. The space of the flow path part 445*b* may be connected to the hole of the discharge part 445*c*. The lower end of the discharge part 445*c* may be provided in the water supply space of the water receiving part 413.

The tilting frame 47 may be connected to the module housing 42 via the tilting shaft 48. The tilting frame 47 may rotatably support the spin shaft 414.

The tilting frame 47 is adapted to be rotatable about tilting rotation axes Ota and Otb within a predetermined range via the tilting shafts 48. The tilting rotation axes Ota and Otb extend in a direction crossing rotation axes Osa and Osb of the spin shaft 414. The tilting shaft 48 may be provided on the tilting rotation axes Ota and Otb. The left tilting frame 47 may be rotatable about the tilting rotation axis Ota within a predetermined range, and the right tilting frame 47 may be rotatable about the tilting rotation axis Otb within a predetermined range.

The tilting frame 47 may be tilted within a predetermined angular range relative to the mop module 40. The tiling frame 47 may allow the inclination angle to be changed depending on a floor condition. The tiling frame 47 may function as a suspension (supporting weight and mitigating vertical vibration at the same time) of the spin mops 41*a* and 41*b*.

The tilting frame 47 may have the frame base 471 forming a lower surface thereof. The spin shaft 414 may be provided to vertically pass through the frame base 471. The frame base 471 may be formed in a plate shape having a vertical thickness. The tilting shaft 48 may rotatably connect the module housing 42 and the frame base 471.

A bearing Ba may be provided between a rotary shaft support 473 and the spin shaft 414. The bearing Ba may include a first bearing provided at a lower side and a second bearing provided at an upper side.

A lower end of the rotary shaft support 473 may be inserted into the water supply space of the water receiving part 413. An inner peripheral surface of the rotary shaft support 473 may support the spin shaft 414.

The tilting frame 47 may include the first support 475 supporting one end of the elastic member 49. The other end of the elastic member 49 may be supported by the second support 42 provided at the module housing 42. When the tilting frame 47 is tilted with respect to the tilting shaft 48, the position of the first support 475 may be changed, and the length of the elastic member 49 may be changed.

The first support 475 may be fixed to the tilting frame 47 at a left side of the left tilting frame 47 and at a right side of the right tilting frame 47. The second support 425 may be provided in a left region of the left spin mop 41*a* and in a right region of the right spin mop 41*b*.

When the titling frame 47 is tilted, the first support 475 may be tilted along with the tilting frame 47. At a minimum inclination angle, a distance between the first support 475 and the second support 425 may be at a minimum. At a maximum inclination angle, a distance between the first support 475 and the second support 425 may be at a maximum. At a minimum inclination angle, the elastic member 49 may be elastically deformed to provide a restoring force.

The tilting frame 47 may have a lower limit contact part 477 provided to come into contact with the lower limit 427. A lower surface of the lower limit contact part 477 may come into contact with an upper surface of the lower limit 427.

The tilting shaft 48 may serve as a rotation axis of the tilting frame 47 and extend in a direction perpendicular to a tilting direction of the spin mops 41*a* and 41*b*. In the embodiment, the tilting shaft 48 may be provided to extend in a horizontal direction and/or may be tilted at an acute angle in the front-rear direction.

The elastic member 49 may apply an elastic force to the tilting frame 47 so that a tilt angle of the lower surface of the spin mops 41*a* and 41*b* relative to the horizontal plane may increase.

When the tilting frame 47 rotates downward, the elastic member 49 may expands, and when the tilting frame 47 rotates upward, the elastic member 49 may contract or compress. The elastic member 49 may allow the tilting frame 47 to act in a shock-absorbing manner (elastically). The elastic member 49 may apply a moment of force to the tilting frame 47 in a direction in which an inclination angle increases.

The rotary plate 412 may be a circular plate-shaped member centered on the spin shaft 414. The floor cloth 411 may be fixed to a lower surface of the rotary plate 412. The rotary plate 412 may rotate the floor cloth 411. The spin shaft 414 may be fixed to the center of the rotary plate 412.

The rotary plate 412 may include a right rotary plate 412 spaced apart from a left rotary plate 412. A lower surface of the left rotary plate 412 may form a downward slope which is inclined leftwardly and forwardly, and a lower surface of the right rotary plate 412 may form a downward slope which is inclined rightwardly and forwardly.

The rotary plate 412 may have a floor cloth fixing part (e.g., Velcro, a hook) at a lower surface of the rotary plate 412 to fix or couple the floor cloth 411. The floor cloth fixing part may detachably fix the floor cloth 411. The floor cloth fixing part may be a hook provided at an edge of the rotary plate 412, but embodiments disclosed herein are not limited. The floor cloth 411 may be provided alone or in combination with a spacer. The floor cloth 411 may contact the floor to wipe the floor.

A water supply hole vertically penetrating the rotary plate 412 may be provided to communicate with the water supply space of the water receiving part 413. Water in the water supply space flows to a lower side of the rotary plate 412 and to the floor cloth 411 through the water supply hole 412*a*. The water supply hole may be provided at or near a center of the rotary plate 412 at a position that does not interfere with the spin shaft 414 and/or overlap or align with the spin shaft 414 in a vertical direction.

The rotary plate 412 may have a plurality of water supply holes. A connection part may be provided between the plurality of water supply holes. The connection part may connect a portion of the rotary plate 412 in a centrifugal direction and a portion of the rotary plate 412 in an opposite direction of the centrifugal direction. Here, the centrifugal direction refers to a radial direction moving away from the spin shaft 414, and the opposite direction of the centrifugal direction refers to a radial direction moving toward the spin shaft 414.

The plurality of water supply holes may be spaced apart from each other along a circumferential direction of the spin shaft 414 at predetermined intervals. The plurality of connection parts may be spaced apart from each other along a circumferential direction of the spin shaft 414. The water supply holes may be provided between the plurality of connection parts.

The rotary plate 412 may include a slope provided at the lower end portion of the spin shaft 414. Water in the water supply space of the water receiving part 413 may flows down by gravity along the slope. The slope may be formed along a circumference of the lower end of the spin shaft 414. The slope may be inclined downward in the opposite direction of the centrifugal direction. The slope may form a lower surface of the water supply hole.

The spin shaft 414 may be fixed to the rotary plate 412 to transmit torque of the mop driving part to the rotary plate 412. The spin shaft 414 may be connected to the upper side of the rotary plate 412. The spin shaft 414 may be provided at the center of the upper side of the rotary plate 412. The spin shaft 414 may be fixed to the center of rotations Osa and Osb of the rotary plate 412. The spin shaft 414 may have a joint fixing part 414*a* to couple to the slave joint 415. The joint fixing part 414*a* may be provided at the upper end of the spin shaft 414.

The water receiving part 413 may form the water supply space, which may surround the circumference of the spin shaft 414 while being spaced apart therefrom. The water supply space may be provided at a center of the upper side of the rotary plate 412. The water receiving part 413 may be cylindrical to define a cylindrical water supply space. The water receiving part 413 may have an open upper side.

The water receiving part 413 may protrude upward from the rotary plate 412. The water receiving part 413 may extend in a circumferential direction of the spin shaft 414 and be a ring-shaped rib. The water supply hole may be provided at an inner lower surface of the water receiving part 413. The water receiving part 413 may be spaced apart from the spin shaft 414.

This application is related to co-pending U.S. Application Ser. No. 16/944,355 filed on Jul. 31, 2020 and Ser. No. 16/943,288 filed on Jul. 30, 2020, the entire contents of which are incorporated by reference herein.

A lower end of the water receiving part 413 may be fixed to the rotary plate 412. An upper end of the water receiving part 413 may have a free end or not be coupled.

According to the present disclosure, the robot cleaner has one or more of the following effects.

Firstly, a water tank-side fixing member and a body-side fixing member may be provided at a water tank and a water tank housing, respectively, such that the water tank may be mounted stably in the water tank housing. In the case where a magnet is used as the body-side fixing member and the water tank-side fixing member, a strong attractive force is generated therebetween, such that the water tank may be fixed stably.

Secondly, a fixing means for fixing the water tank may only be provided near a pipe for supplying water, and a separation prevention unit for preventing the water tank from being separated from the body may be provided at a position opposite the pipe such that a strong coupling force generated near the pipe may prevent leakage, and the water tank may be separated easily by a leverage effect produced by rotating the water tank with respect to the separation prevention unit, thereby reducing damage of the water tank during the separation.

Thirdly, an edge locking portion, being exposed at an outer surface of the body when the water tank and the body are connected, may be provided at a position opposite the fixing means for fixing the water tank such that the water tank rotates while being locked to the outer surface of the body to be separated from the body, thereby producing a leverage effect and facilitating separation of the separation prevention means.

Fourthly, each of the body-side fixing member and the water tank-side fixing member may be arranged in a ring shape around a circumference of a supply nozzle and a discharge nozzle being provided for the flow of water, and the body-side fixing member and the water tank-side fixing member may be firmly pressed against each other to prevent water leakage, thereby enabling smooth supply of water to spin mops.

Fifthly, a sealer or gasket may be provided at a portion where the fixing member is provided to prevent water from flowing to the magnet, thereby maintaining a magnetic force, generated by the magnet, for an extended period of time, and securing a long service life of the magnet.

Sixthly, a handle for withdrawing the water tank from the water tank housing may be provided at a position where the fixing member is provided, thereby allowing a user to easily draw out the water tank, and providing convenience in using the water tank.

Embodiments disclosed herein may provide a robot cleaner including a detachable water tank in which the mounted water tank may be stably fixed. Embodiments disclosed herein may provide a robot cleaner including a detachable water tank in which water leakage, occurring at a portion where the water tank is connected, may be minimized. Embodiments disclosed herein may provide a robot cleaner maintaining strong fixation or coupling at a connection portion between the water tank and the body but configured such that little force is required for a user to separate the water tank.

Embodiments disclosed herein may provide a robot cleaner in which a fixing means is provided at one side of a water tank, and while rotating about the other side of the water tank as a center of rotation, the water tank may be connected to or separated from the body, thereby allowing smooth connection and separation between the water tank and the body.

The objects of the present disclosure are not limited to the aforementioned objects and other objects not described herein will be clearly understood by those skilled in the art from the following description.

Embodiments disclosed herein may be implemented as a robot cleaner in which a fixing means generating a magnetic force is provided at one side of a water tank, and while rotating about the other side of the water tank, the water tank may be connected to or separated from the body.

Embodiments disclosed herein may be implemented as a robot cleaner including a water tank forming a space for storing water, a body having a water tank housing formed at a rear side thereof, the water tank housing forming a mounting space in which the water tank is mounted, a pair of spin mops rotatably mounted at a lower side of the body, and adapted to move the body by rotating and to mop a surface to be cleaned, a supply nozzle provided at one side of the water tank housing, and when connected to the water tank, supplying the water stored in the water tank to each of the pair of spin mops, a discharge nozzle provided at a position spaced apart from a center of the water tank in a first direction, and when the water tank is mounted in the water tank housing, connected to the supply nozzle to communicate the water tank with the supply nozzle, a fixing unit providing a coupling force between the water tank housing and the water tank by generating a magnetic force, and being spaced apart from the center of the water tank in the first direction, and a separation prevention unit spaced apart from the center of the water tank in a direction opposite the first direction and restricting forward and backward movement of the water tank in the mounting space.

The water tank may be separated from the water tank housing by rotating about a point, adjacent to the separation prevention unit, in a forward direction. The water tank may be connected to the water tank housing by rotating about the point, adjacent to the separation prevention unit, in a reverse direction. The water tank may be separated from the water tank housing by rotating in the forward direction about an edge of the water tank housing adjacent to the separation prevention unit.

The fixing unit may include a water-tank side fixing member provided at the water tank and a body-side fixing member corresponding to the water tank-side fixing member provided in the water tank housing.

The water tank housing may include an opening, through which the water tank enters, a housing front surface provided to face the opening, and a first housing side surface and a second housing side surface, intersecting the housing front surface, having one end which defines a portion of the edge of the opening and the other end which is connected to the housing front surface, and being provided to face other. The body-side fixing member may be provided on the housing front surface. The body-side fixing member may be provided on the housing front surface at a position adjacent to the first housing side surface.

The separation prevention unit may further include a separation prevention groove formed at the second housing side surface and defining a space in which a portion of the water tank is locked. The separation prevention groove may be biased toward the edge of the opening from a center of the second housing side surface.

The water tank may include a water tank case forming a space for storing water. The water tank case may have a case front surface facing the housing front surface when the water tank is connected to the water tank housing, a first case side surface and a second case side surface facing the first housing side surface and the second housing side surface, and a case rear surface exposed to the outside. The water tank-side fixing member may be provided at the case front surface.

The separation prevention unit may include a separation prevention rib protruding from the second case side surface. The separation prevention rib may include a first portion extending from the second case side surface in a direction intersecting the second case side surface and a second portion connected to the first portion, and extending in a direction intersecting the first portion.

The separation prevention unit may include a stopper having an elastic restoring force to the mounting space from the second housing side surface and a stopper groove which is formed at the second case side surface and into which the stopper is inserted.

The water tank may further include an edge locking portion being locked on the edge of the opening of the water tank housing. While being locked on the edge of the opening by the edge locking portion, the water tank may rotate to be separated from the water tank housing.

Embodiments disclosed herein may be implemented as a robot cleaner, including a water tank forming a space for storing water, a body having a water tank housing formed at a rear side thereof, the water tank housing forming a mounting space in which the water tank is mounted, a pair of spin mops rotatably mounted at a lower side of the body and adapted to move the body by rotating and to mop a surface to be cleaned, a water tank-side fixing member provided at the water tank and connected to the water tank housing, a separation prevention unit provided at a position opposite the water tank-side fixing member relative to a center of the water tank and restricting forward and backward movement of the water tank in the mounting space, and an edge locking portion provided at a position opposite the water tank-side fixing member relative to the center of the water tank and being locked on an edge of an opening of the water tank housing.

While being locked on the edge of the opening by the edge locking portion, the water tank may rotate in a forward direction to be separated from the water tank housing. While being locked on the edge of the opening by the edge locking portion, the water tank may rotate in a reverse direction to be connected to the water tank housing.

The edge locking portion and the separation prevention unit may be provided on one same surface of the water tank. The water tank-side fixing member may be provided at another surface of the water tank intersecting the one surface of the water tank on which the edge locking portion and the separation prevention unit are provided.

According to the present disclosure, the robot cleaner has one or more of the following effects.

Firstly, as a water tank-side fixing member and a body-side fixing member are provided at a water tank and a water tank housing, respectively, the water tank may be mounted stably in the water tank housing. In the case where a magnet is used as the body-side fixing member and the water tank-side fixing member, a strong attractive force is generated therebetween, such that the water tank may be fixed stably.

Secondly, a fixing means to fix or couple the water tank may only be provided near a pipe for supplying water, and a separation prevention unit for preventing the water tank from being separated from the body may be provided at a position opposite the pipe such that a strong coupling force generated near the pipe may prevent leakage, and the water tank may be separated easily by a leverage effect produced by rotating the water tank with respect to the separation prevention unit, thereby reducing damage of the water tank during the separation.

Thirdly, an edge locking portion, being exposed at an outer surface of the body when the water tank and the body are connected, may be provided at a position opposite the fixing means for fixing the water tank, such that the water tank rotates while being locked to the outer surface of the body, to be separated from the body, thereby producing a leverage effect, and facilitating separation of the separation prevention means.

Fourthly, each of the body-side fixing member and the water tank-side fixing member may be arranged in a ring shape around a circumference of a supply nozzle and a discharge nozzle being provided for the flow of water, and the body-side fixing member and the water tank-side fixing member may be firmly pressed against each other to prevent water leakage, thereby enabling smooth supply of water to spin mops.

Fifthly, a sealer may be provided at a portion where the fixing member is provided to prevent water from flowing to the magnet, thereby maintaining a magnetic force, generated by the magnet, for an extended period of time, and securing a long service life of the magnet.

Sixthly, a handle for withdrawing the water tank from the water tank housing may be provided at a position where the fixing member is provided, thereby allowing a user to easily draw out the water tank, and providing convenience in using the water tank.

However, the effects of the present disclosure are not limited to the aforesaid, and other effects not described herein will be clearly understood by those skilled in the art from the following description of the appended claims.

While the present disclosure has been shown and described with reference to the preferred embodiments thereof, it should be understood that the present disclosure is not limited to the aforementioned specific embodiments, and various modifications and variations may be made by those skilled in the art without departing from the scope and spirit of the invention as defined by the appended claims, and the modified implementations should not be construed independently of the technical idea or prospect of the present disclosure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A robot cleaner, comprising:

a tank configured to store a liquid;

a body having a recess, the recess forming a mounting space in which the tank is configured to be mounted;

at least one spin mop rotatably mounted at a lower side of the body, and configured to move the body across a surface by rotating and to clean the surface with the liquid;

a supply nozzle protruding from the recess into the mounting space;

a discharge nozzle protruding from the tank and configured to couple to the supply nozzle when the tank is mounted such that the liquid from the tank flows to the spin mop via the supply and discharge nozzles;

a first coupler configured to couple the tank to the recess via magnetic attraction; and a second coupler having at least one of a groove or a protrusion and configured to couple the tank to the recess and to restrict a rearward movement of the tank in the mounting space, wherein with respect to a front-rear axis defining a left-right center of the recess, the first coupler is provided at a first side with respect to the front-rear axis and the second coupler is provided at a second side opposite the first side, wherein the tank includes an edge protrusion protruding from an edge of the tank defined by a side surface and a rear surface of the tank, and the edge protrusion is configured to contact an edge of the recess defined by a side surface of the recess and a side surface of the body, and wherein, when the tank is pulled to be separated from the recess, the tank is rotated around a vertical axis of rotation while the edge protrusion maintains contact with the body.

2. The robot cleaner of claim 1, wherein, when the tank is pulled to separate the tank from the recess, the tank is rotated in a first direction about an edge of the recess adjacent to the second coupler.

3. The robot cleaner of claim 1, wherein, when the tank is pulled to separate the tank from the recess, the tank is rotated in a first direction about a point adjacent to the second coupler.

4. The robot cleaner of claim 3, wherein, when the tank is inserted into the recess to be mounted to the recess, the tank is rotated about the point in a second direction opposite to the first direction.

5. The robot cleaner of claim 1, wherein the first coupler comprises:

a first magnet provided at one of the tank or the recess; and a second magnet or metal provided at another one of the tank or the recess, configured to be magnetically attracted to the first magnet, and positioned to align with the first magnet when the tank is mounted in the recess.

6. The robot cleaner of claim 5, wherein the side surface of the recess is a second side surface, and the recess comprises:

an opening through which the tank enters;

a front surface facing the opening and provided adjacent to a front of the tank when the tank is mounted in the recess; and a first side surface extending from a first end of the front surface, wherein the second side surface extends from a second end of the front surface and faces the first side surface, the first and second side surfaces defining sides of the opening, and wherein the first magnet is provided at the front surface of the recess.

7. The robot cleaner of claim 6, wherein the first magnet is provided on the front surface of the recess at a position adjacent to the first side surface of the recess.

8. The robot cleaner of claim 6, wherein the at least one of the groove or the protrusion of the second coupler includes the groove and the groove is formed at the second side surface of the recess, the groove defining a space in which a portion of the tank is received.

9. The robot cleaner of claim 8, wherein the groove is provided to be closer to the opening than the front surface of the recess.

10. The robot cleaner of claim 6, wherein the side surface of the tank is a second side surface, and the tank comprises:

a front surface configured to face the front surface of the recess when the tank is mounted in the recess;

a first side surface configured to face the first side surface of the recess when the tank is mounted, the second side surface of the tank being configured to face the second side surface of the recess when the tank is mounted; and a rear surface exposed to an outside of the recess, wherein the second magnet is provided at the front surface of the tank.

11. The robot cleaner of claim 10, wherein the at least one of the groove or the protrusion of the second coupler includes the protrusion and the groove, and wherein:

the protrusion is a stopper coupled to an elastic member, which is coupled to the second side surface of the recess; and the groove is a stopper groove formed at the second side surface of the tank and into which the stopper is inserted.

12. The robot cleaner of claim 10, wherein the at least one of the groove or the protrusion of the second coupler includes the protrusion, and the protrusion is a rib protruding from the second side surface of the tank.

13. The robot cleaner of claim 12, wherein the rib comprises:

a first section extending in a left-right direction toward the second side surface of the recess; and a second section bent from the first section to extend in a front-rear direction.

14. A robot cleaner, comprising:

a tank configured to store a liquid;

a body having a dock formed at a rear side, the dock being configured to receive the tank;

a spin mop rotatably mounted at a lower side of the body and configured to receive the liquid;

a magnetic coupler coupling the tank to the dock via a pair of magnets or a magnet and a ferromagnetic material, the magnetic coupler provided at one of a left side or a right side of the dock;

a mechanical coupler provided at another one of the left side or the right side and configured to restrict rear movement of the tank via a groove and a protrusion; and an edge protrusion protruding from the tank and configured to contact an edge of the dock, the edge being provided at a second side of the dock, wherein, when pulled rearward to be separated from the tank, the tank is rotated around a vertical axis of rotation while maintaining contact with the second side of the dock, and wherein the edge protrusion and a portion of the mechanical coupler are provided at a side surface of the tank that faces a side surface of the dock.

15. The robot cleaner of claim 14, wherein, when pushed forward to be mounted in the dock, the tank is rotated while maintaining contact with the second side of the dock.

16. The robot cleaner of claim 14, wherein the magnetic coupler includes:

a first magnet provided the dock; and at least one of a second magnet or a piece of metal that is provided at the tank, configured to be magnetically attracted to the first magnet, and positioned to align with the first magnet when the tank is received in the dock.

17. The robot cleaner of claim 16, wherein the first magnet is provided at a front surface of the dock that faces a front surface of the tank, the front surface of the dock extending from the side surface of the dock, and the front surface of the tank extending from the side surface of the tank.

18. The robot cleaner of claim 16, wherein the side surface of the dock is a second side surface, and the dock further includes:

an opening through which the tank enters;

a front surface facing the opening and provided adjacent to a front of the tank when the tank is mounted in the dock; and a first side surface extending from a first end of the front surface, wherein the second side surface extends from a second end of the front surface and faces the first side surface, the first and second side surfaces defining sides of the opening, and wherein the first magnet is provided on the front surface of the dock at a position adjacent to the first side surface of the dock.

19. The robot cleaner of claim 18, wherein the side surface of the tank is a second side surface, and the tank includes:

a front surface configured to face the front surface of the dock when the tank is mounted in the dock;

a first side surface configured to face the first side surface of the dock when the tank is mounted, the second side surface of the tank being configured to face the second side surface of the dock when the tank is mounted; and a rear surface exposed to an outside of the dock, wherein the second magnet is provided at the front surface of the tank.

20. The robot cleaner of claim 19, wherein the second coupler includes a rib protruding from the second side surface of the tank, and wherein the rib includes:

a first section extending in a left-right direction toward the second side surface of the dock; and a second section bent from the first section to extend in a front-rear direction.

* * * * *